United States Patent [19]

Asel et al.

[11] 4,046,089

[45] Sept. 6, 1977

[54] MACHINE FOR MAKING SHOULDER STRAPS

[75] Inventors: John R. Asel, Lorraine; Roger Allaire, St. Leonard; Peter Thalmann, Lachine; Rene Castonguay, Montreal, all of Canada

[73] Assignee: Canadian Lady-Canadelle Inc., W. Montreal, Canada

[21] Appl. No.: 679,424

[22] Filed: Apr. 22, 1976

[30] Foreign Application Priority Data

May 14, 1975 United Kingdom ..... 20441/75

[51] Int. Cl.[2] ..... D05B 3/12

[52] U.S. Cl. ..... 112/265; 112/121.27; 223/49

[58] Field of Search ..... 112/104, 121.15, 121.27, 112/121.25, 27, 86, 102; 223/49

[56] References Cited

U.S. PATENT DOCUMENTS

| | | | |
|---|---|---|---|
| 2,770,204 | 11/1956 | Brownstein | 223/49 X |
| 2,955,730 | 10/1960 | Sonntag et al. | 223/49 |
| 3,150,804 | 9/1964 | Edelman | 223/49 |
| 3,497,116 | 2/1970 | Herron et al. | 223/49 |

*Primary Examiner*—G. V. Larkin

*Attorney, Agent, or Firm*—Beveridge, DeGrandi, Kline & Lunsford

[57] ABSTRACT

A machine for forming shoulder straps for ladies garments, of the type having a first tape with a buckle secured to one end and a second (elastic) tape having a ring secured to its end, the two tapes being united by passing the free end of the first tape through the ring and then back through the two slots of the buckle. The machine described is supplied with spools of tape, and with buckles and rings, and performs all the operations needed to produce the strap including sewing of the buckles and rings in place, and the threading and buckling operations, as well as cutting off suitable lengths of the tapes. The means for uniting the first and second tapes comprises a first clamping device for holding the buckle end of the first tape with the buckle disposed substantially perpendicular to the tape, and a second clamping device having a narrow projecting end for holding the free end of the first tape and being suitably dimensioned for inserting this free end through the ring of the second tape, and subsequently into a slot of the buckle. These clamping devices are moved between an initial position in which the free end of the first tape is held horizontally for receiving the ring, and a final position in which the free end has been rotated through 180° and can then be inserted into a slot of the buckle. Buckling means are provided for completing the buckling of the first tape through the second slot of the buckle.

19 Claims, 35 Drawing Figures

SEE FIG-3A
4
14
14a
281
281a
42
267
228
226
14a
284
260
270
14
274
280
283
282
272
44
46
262
244
224
237
237a
239
220
221
230
235
257
252
252a
48
45
16
287
202
288
230
264
40
38
200
206
212b
207

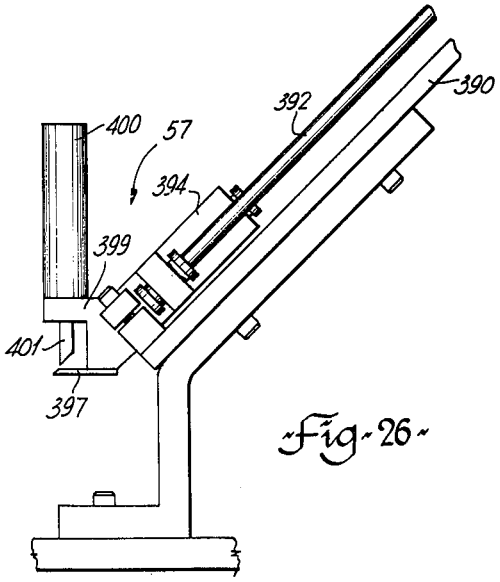
Fig. 26
Fig. 27
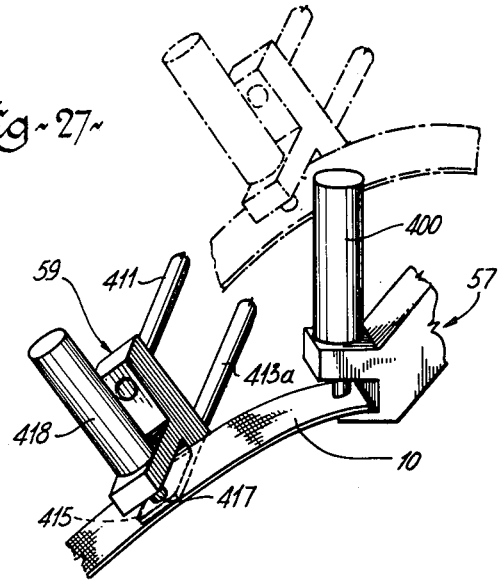

MACHINE FOR MAKING SHOULDER STRAPS

The present invention relates to a machine for forming shoulder straps for ladies garments particularly brassieres. Such a shoulder strap is formed of two parts united together, namely a first strap portion comprising a first tape having secured to one end a buckle (or so-called side) with two slots, and a second strap portion comprising a second tape having a ring secured thereto, the two strap portions being united by passing the free end of the first tape (i.e., that end remote from the buckle) through the ring and then back through the two slots of the buckle. A strap of this kind, which is well known in the art, will be referred to hereinafter as being "of the type defined". The first tape is preferably inelastic, and the second tape is preferably elastic. The term "ring" as used herein means an element having an aperture for receiving a tape therethrough, as for attaching said tape to another tape also received through the ring, and will be understood as not limited to a circular ring having only one aperture.

The buckle and ring are conventionally secured to their respective strap portions by sewing together a main portion of the respective tape and an end portion thereof after the latter portion has been passed through the two slots of the buckle or through the ring as appropriate. However, instead of sewing, an ultrasonic welding step may be used with appropriate synthetic fabrics. The term "joining machine" will be used to signify either a sewing machine or another type of machine, for example an ultrasonic welding machine, which can join together two parts of a tape.

Manufacture of these shoulder straps has hitherto involved much manual labour. The only machine known to applicants which manufactures shoulder straps of this type is the machine shown in U.S. Pat. No. 3,497,116 to Herron et al, which issued Feb. 24, 1970. The Herron machine is complicated, and is understood to be not entirely satisfactory in operation. The present invention provides a machine which is different from that of the Herron machine in very many ways. One particular difference lies in the arrangement used to unite the two parts of the strap together when these have been formed in separate sections of the machine.

In accordance with one aspect of the present invention, apparatus for forming a strap of the type described includes means for uniting the first and second strap portions, these means comprising:

a first clamping device for holding the buckle end of the first strap portion with the buckle disposed substantially perpendicular to the end of the first strap portion adjacent said buckle, a second clamping device having a narrow projecting end for holding the free end of the first strap portion and being suitably dimensioned for inserting this free end through the ring of the second strap portion, and also into a slot of the buckle, means for causing relative movement of said clamping devices between an initial position in which the free end of the first strap portion is suitably orientated for receiving the ring, and a final position in which the said free end is inserted into a first slot in said buckle.

The apparatus also preferably includes means for bending the free end of the first strap portion which projects through the first buckle slot towards the second buckle slot, and means for subsequently inserting the free end through the second slot.

Preferably, means are also provides for pulling the free end of the tape through the buckle so as to suitably position the buckle on the tape of the strap portion.

This type of arrangement for uniting the two strap portions by holding the first tape with a clamping device and passing the first tape through the ring of the second strap portion and then successively through two slots in the buckle is quite different from the arrangement described in the aforesaid Herron patent, in which the buckle is made to overlie the ring, in close proximity, while the tape is pushed upwards and downwards through, firstly, the ring and a first slot in the buckle, and then through a second slot in the buckle. With the present arrangement, the free end of the first strap portion is threaded endwise through both the ring and the first buckle slot while being held by the second clamping device.

The first clamping device preferably has a movable door which clamps onto the outside portion of the buckle to hold this in vertical position during the threading operations.

The means for causing relative movement between the clamping devices preferably include means causing relative linear movement from relatively separated to co-operating positions, and means causing relative rotation of the clamping devices to align the second clamping device with the first buckle slot. Preferably, means are provided for rotating the second clamping device through 180° from an orientation in which the tape is held substantially flat with its free end pointing away from the buckle, to an orientation in which the free end is pointing towards a slot in the buckle. This arrangement is particularly convenient in association with a first section of the machine which unites the buckle with the first tape to form the first strap portion, and which then holds the tape straight after the buckle has been sewn in position. With this arrangement, transfer of the first strap portion from the first section of the machine to the clamping devices is achieved simply by arranging that the means causing movement of the clamping devices also provide for translational movement from an advanced position in which the clamping devices clamp onto the first tape while this is held in the first section of the machine, to a retracted position in which later position the second clamping device is rotated and the clamping devices are relatively moved (as described) to thread the free end of the first tape through the buckle slot.

Furthermore, the arrangement whereby the two clamping devices transfer the first strap portion to a retracted position in flat condition with its free outer end pointing away from the buckle, allows the two strap portions to be united very simply at this stage by placing the ring of the second strap portion onto the projecting outer end of the first strap portion, before this is moved by the second clamping device and threaded through the buckle. The second strap portion is formed in a second section of the machine which includes a holding and transfer device for holding the ring in a first position during threading of the second tape therethrough, and in a second position during sewing (or otherwise securing) of the second tape onto the ring. Further in accordance with the invention, one position of the first strap portion when held by the two clamping devices is aligned with the said two positions of the ring during threading and securing to the second tape, so that the ring can easily be moved onto the projecting end of the first strap portion by further movement of the ring by the holding and transfer device along the same path as this moves to transfer the ring from the threading to the sewing position. The tape while held by the two clamping devices in their retracted positions is preferably disposed horizontally, and the ring is preferably also horizontal while the second tape is being threaded therethrough and sewn onto the ring, so that threading of the ring onto the strap involves a 90° rotation achieved by the ring holding and transfer device.

A further aspect of this invention concerns the ring holding and transfer device. This device has clamping means for receiving a ring from a magazine, holding the ring horizontally during threading of the second tape therethrough, moving the ring horizontally to a position in which parts of the tape adjacent the ring are joined, for example by sewing, and further moving the ring in the horizontal direction and rotating the ring into the vertical plane for feeding the ring onto the horizontally extending free end of the first strap portion. In order for the clamping means to be capable of releasing the ring after this has been threaded onto the first strap, the clamping means engages only a portion of the ring adjacent to or between mutually perpendicular diameters of the ring, so that the clamping means can accept the ring by relative movement between the ring and the clamping member in a first direction and can release the ring by relative movement in a direction perpendicular to the first direction. The latter movement is achieved by tilting a portion of the holding and transfer device about a horizontal axis when the ring has been rotated into a vertical plane.

The present invention also includes the method of operation of the machine, and for example in accordance with one aspect of the invention the method for uniting the first and second strap portions includes the steps of a. holding the first strap portion substantially flat with the buckle disposed substantially perpendicular to the strap portion,
b. feeding the ring attached to the second strap portion onto the projecting end of the first strap portion,
c. rotating the free end of the first strap portion while causing relative movement between this free end portion and the buckle to bring the free end of the first strap portion adjacent to and into alignment with a first slot in the buckle, and then inserting the free end portion into this slot, and
d. bending the free end portion of the first strap portion projecting through the first slot in the buckle and then feeding this through the second slot in the buckle.

The aspects of the invention described above relate to uniting of the strap portions to form the completed strap, these operations being done in a third section of the machine, the machine having the first and second sections which form the first and second strap portions respectively. Features of these sections of the machine are claimed in our co-pending U.S. Pat. applications Nos. 679,423 and 679,425, filed concurrently herewith.

Various other aspects of the invention are defined in the claims attached hereto. These include the novel means in the second section of the machine for supplying and supporting a ring and for threading the second tape through the ring; and novel means in the third section of the machine for buckling the free end portion of the first strap means through the buckle and pulling this end through the buckle. Other features of the machine allow ready adjustment of the first two sections to produce strap portions of different lengths, and ready adaptability of the machine to accept different widths of tape.

A specific embodiment of the present invention will now be described by way of example with reference to the accompanying drawings, in which.

Figure 2:
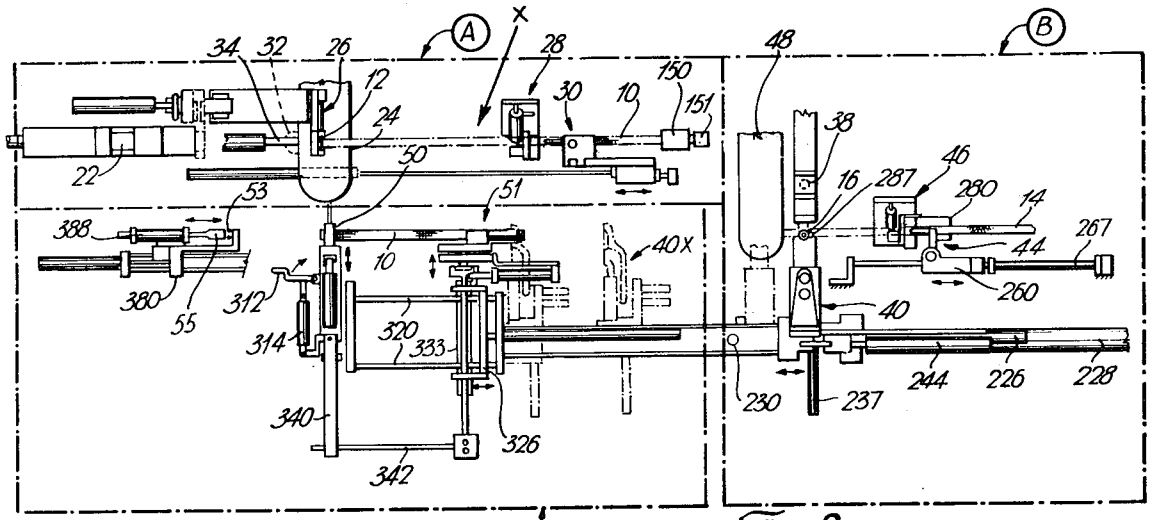
FIG. 2 shows a diagrammatic plan view of the whole machine taken on a plane just above the level occupied by the first and second tape during most of the machine operations, this drawing showing the division of the machine into the main sections A, B and C.
Figure 3A:
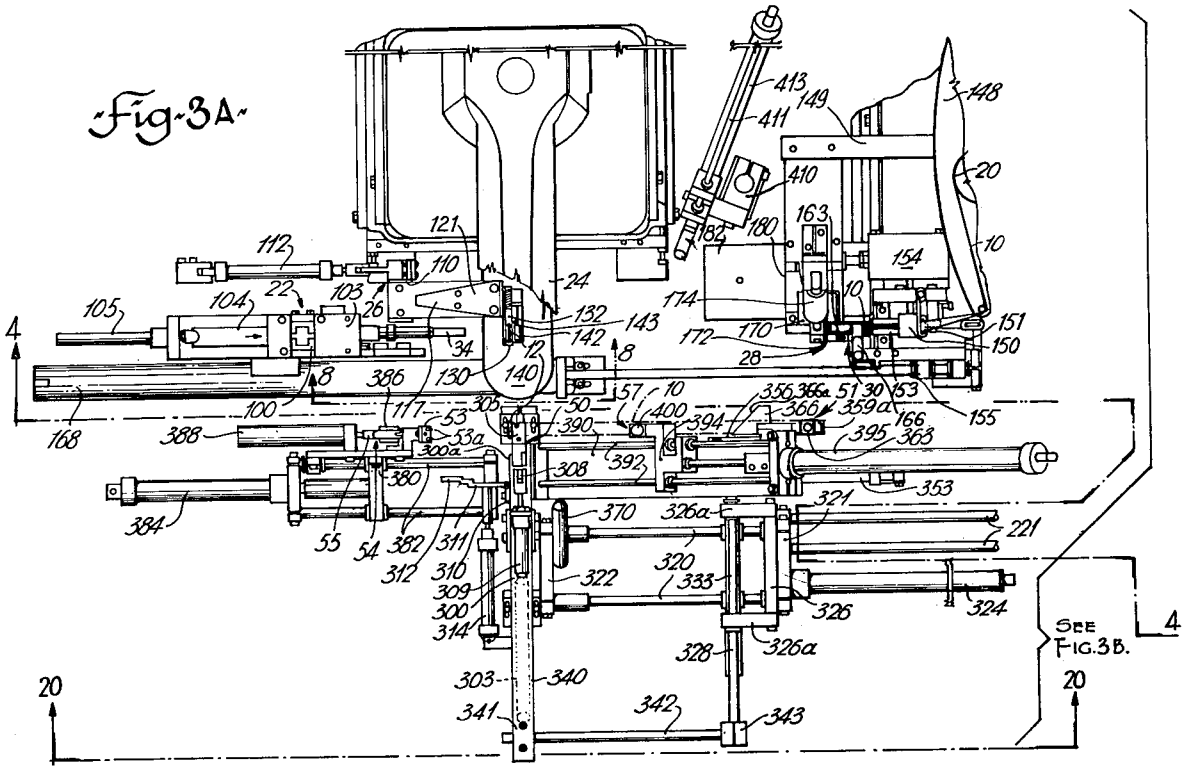
FIGS. 3A and 3B show overall detail plan views of the left hand portions and right hand portions of the machine, respectively.
Figure 3B:
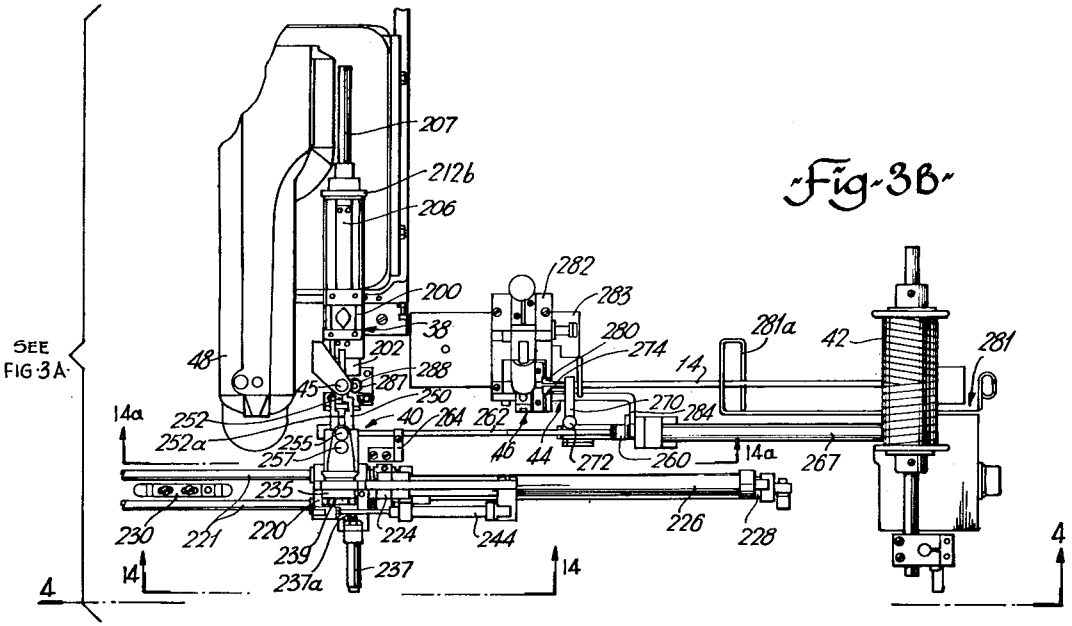
Figure 4A:
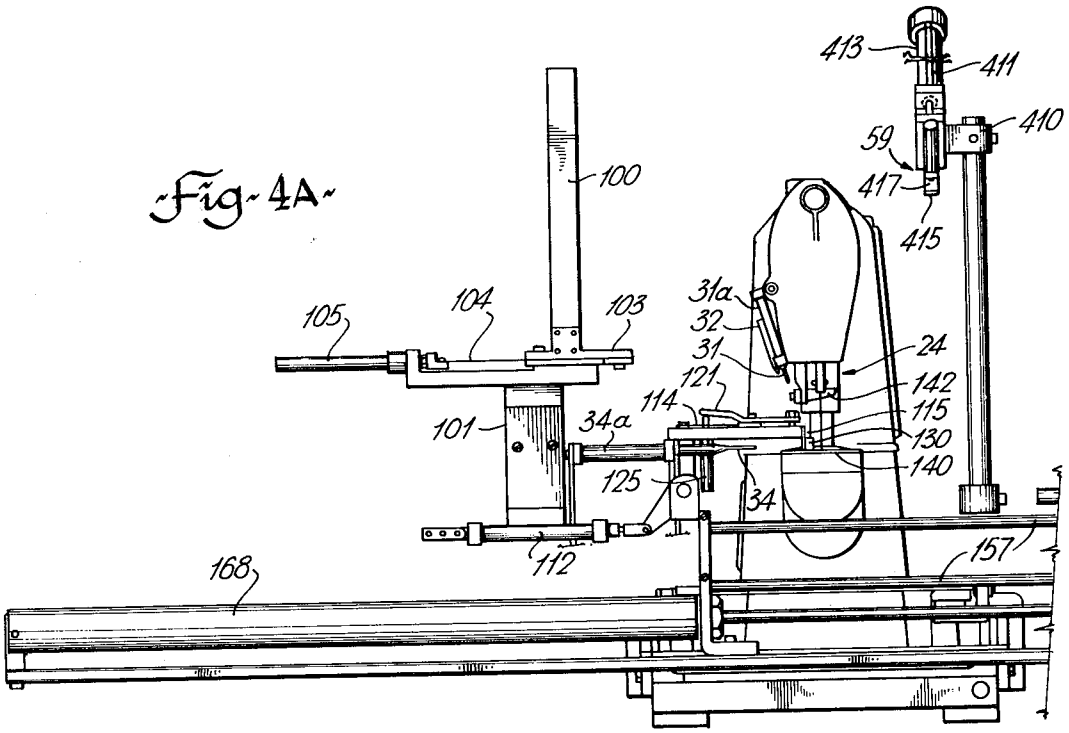
Figure 4B:
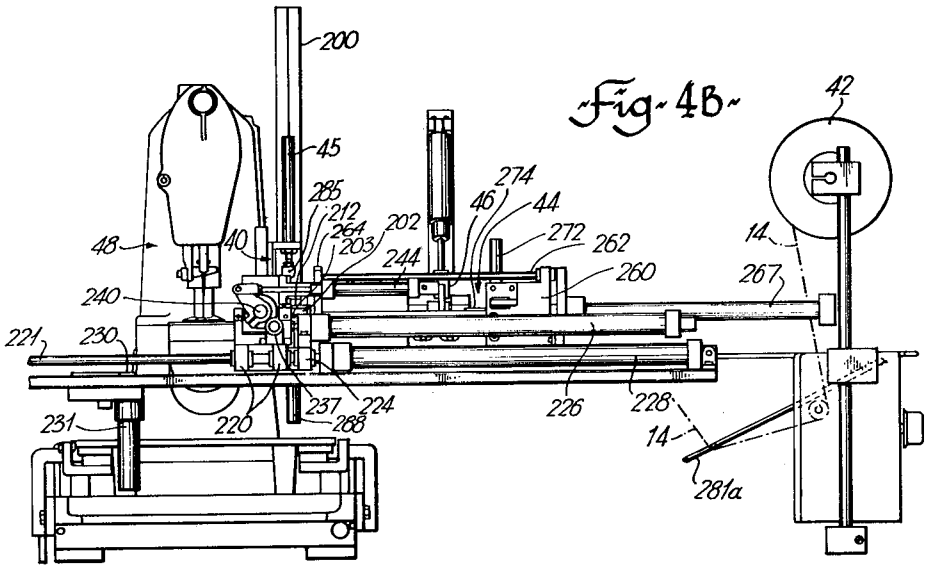
Figure 5:
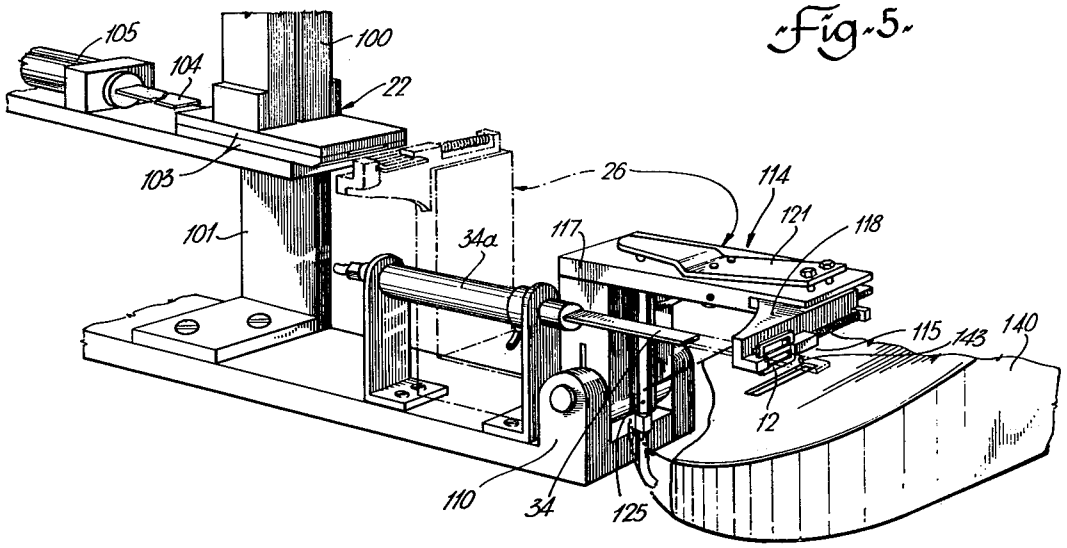
Figure 6:
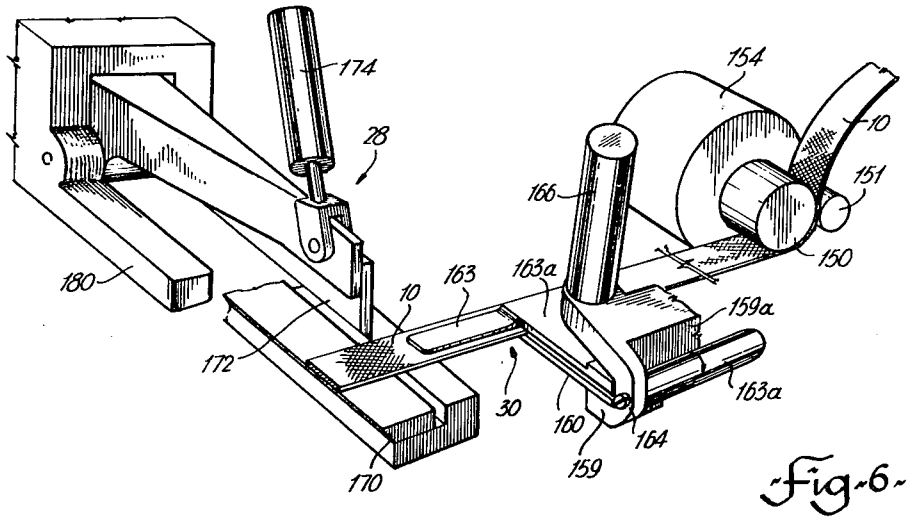
Figure 7:
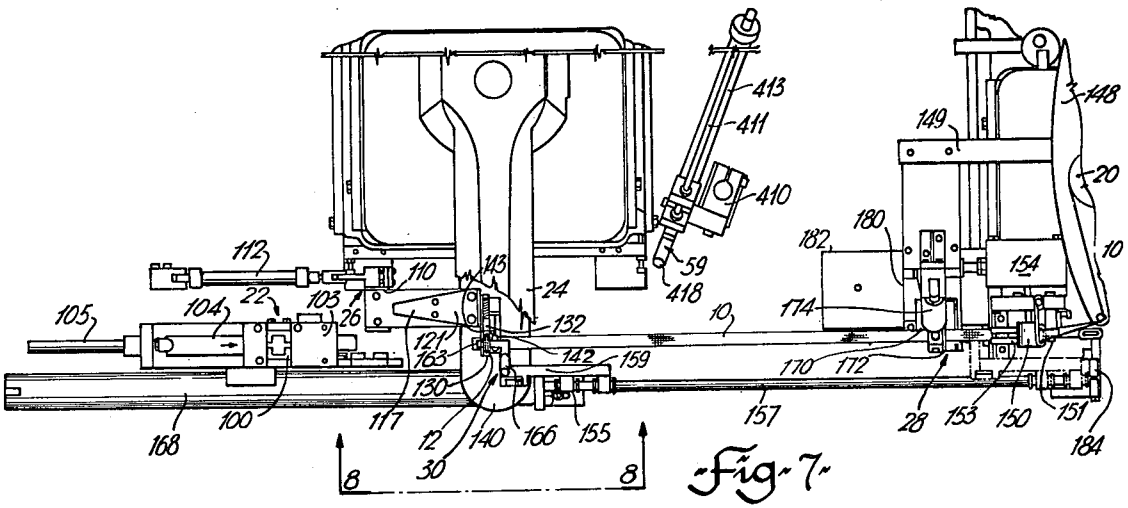
Figure 8:
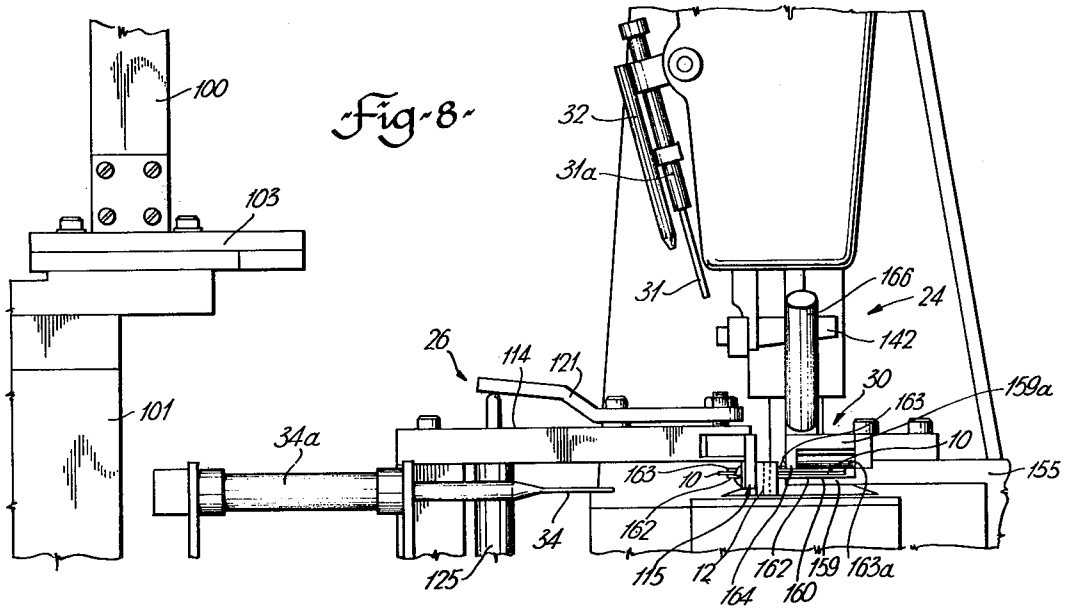
Figure 9:
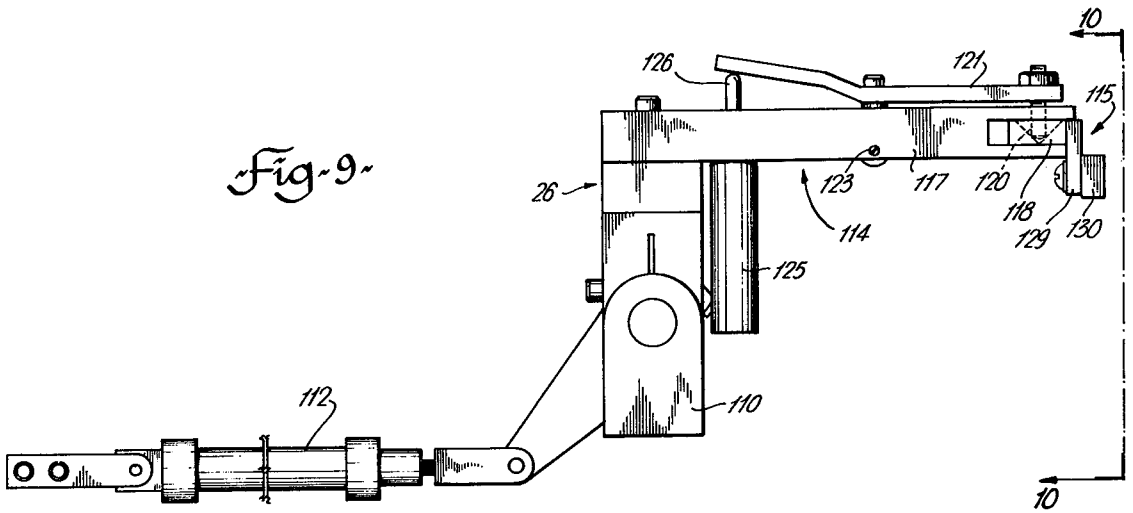
Figure 14B:
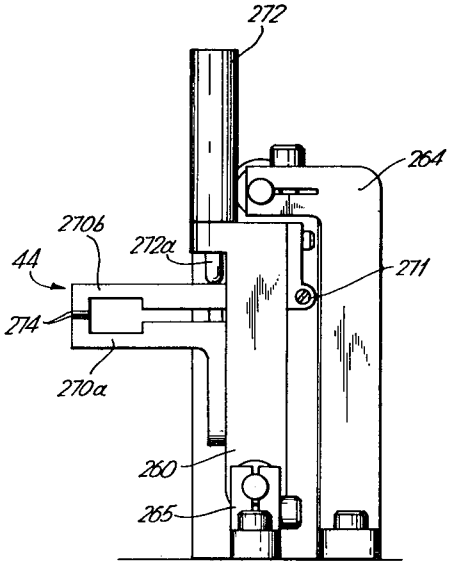
Figure 10:
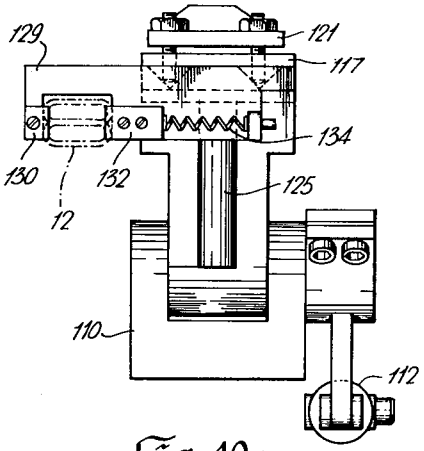
Figure 11:
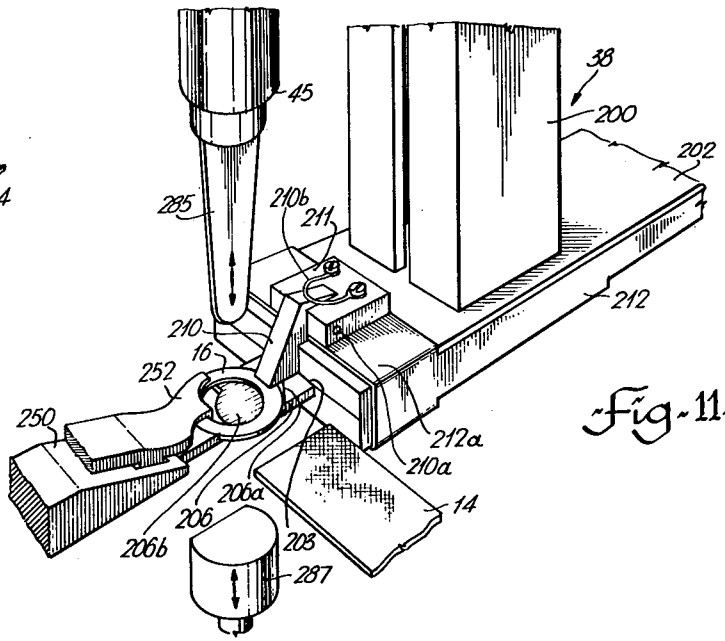
Figure 12:
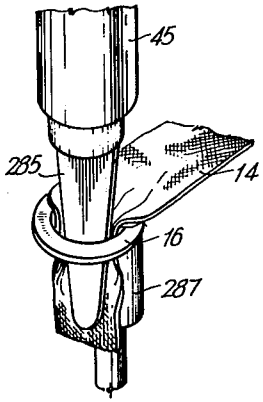
Figure 13:
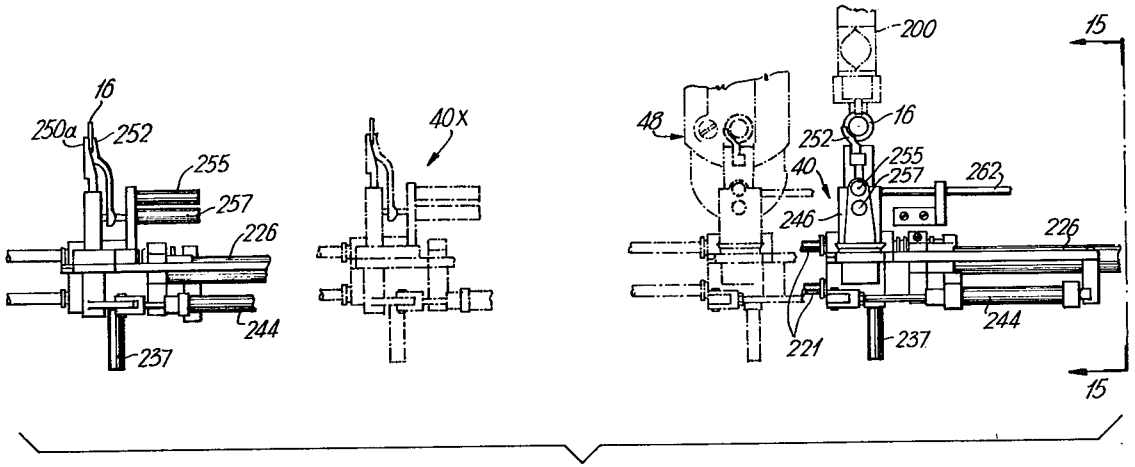
Figure 14:
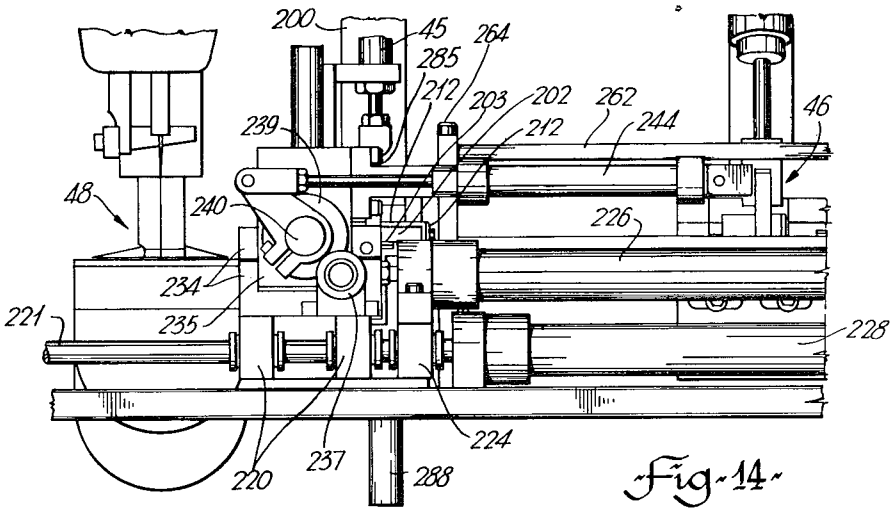
Figure 14A:
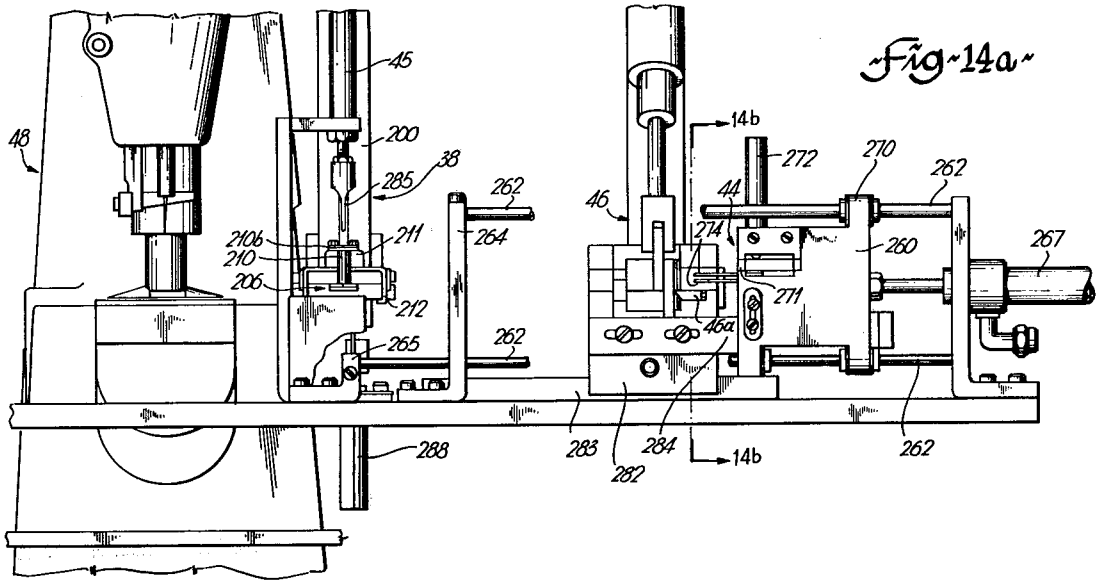
Figure 15:
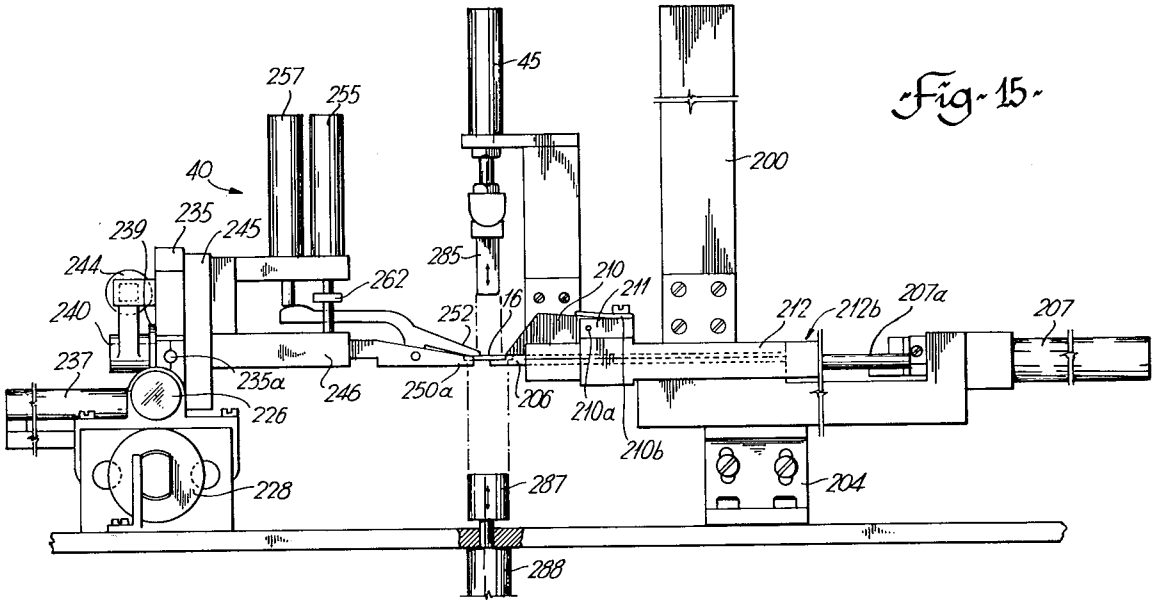
Figures 16, 16A:
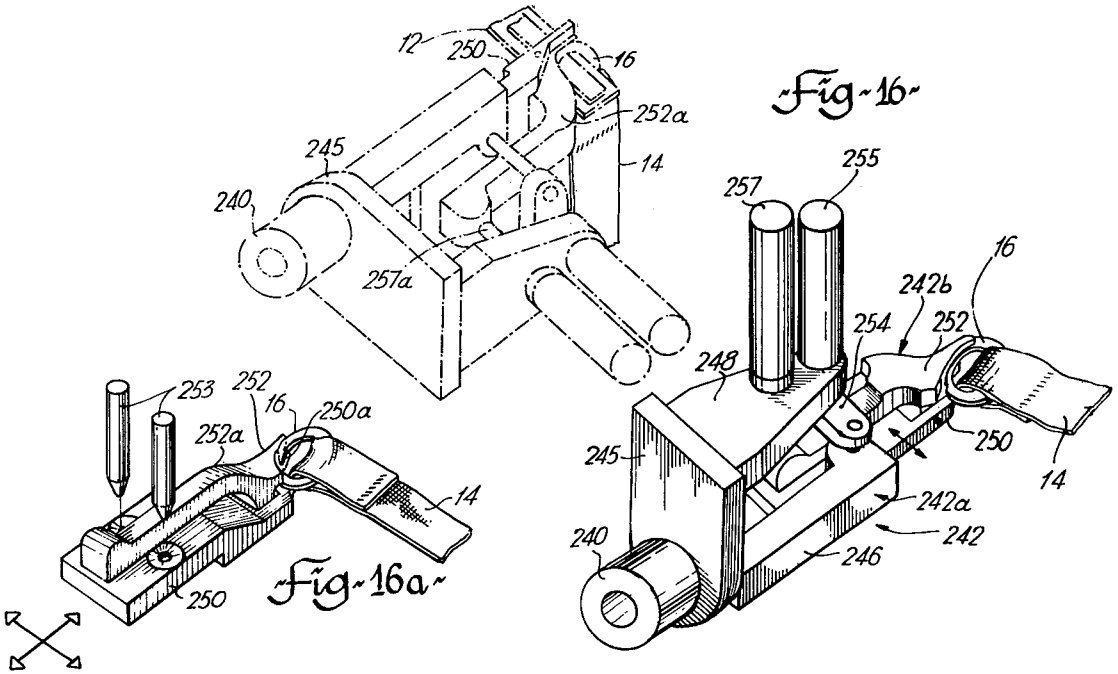
Figure 17:
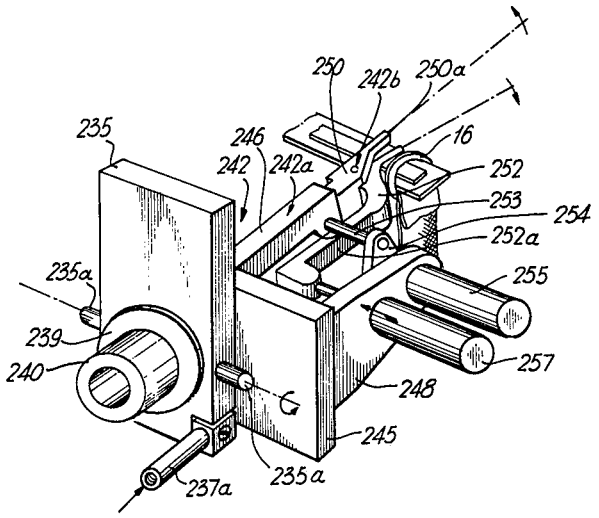
Figure 18:
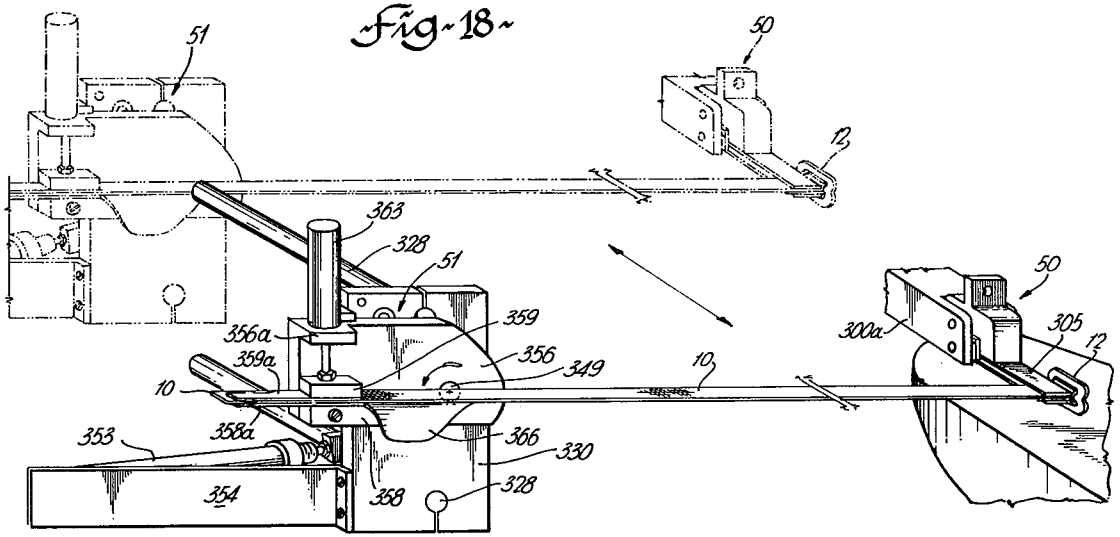
Figure 19:
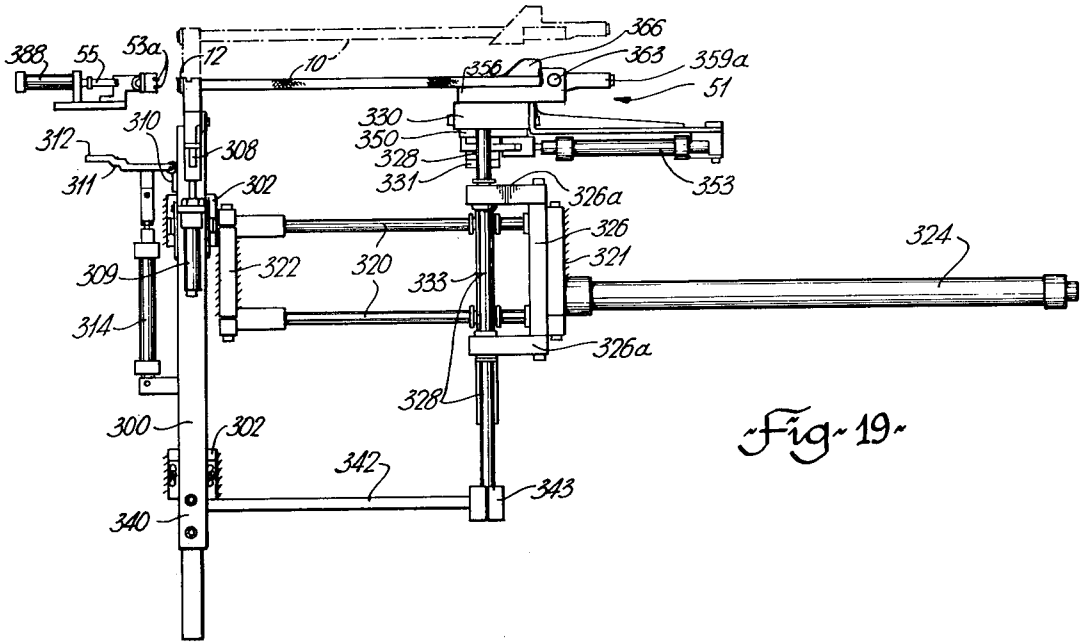
Figure 20:
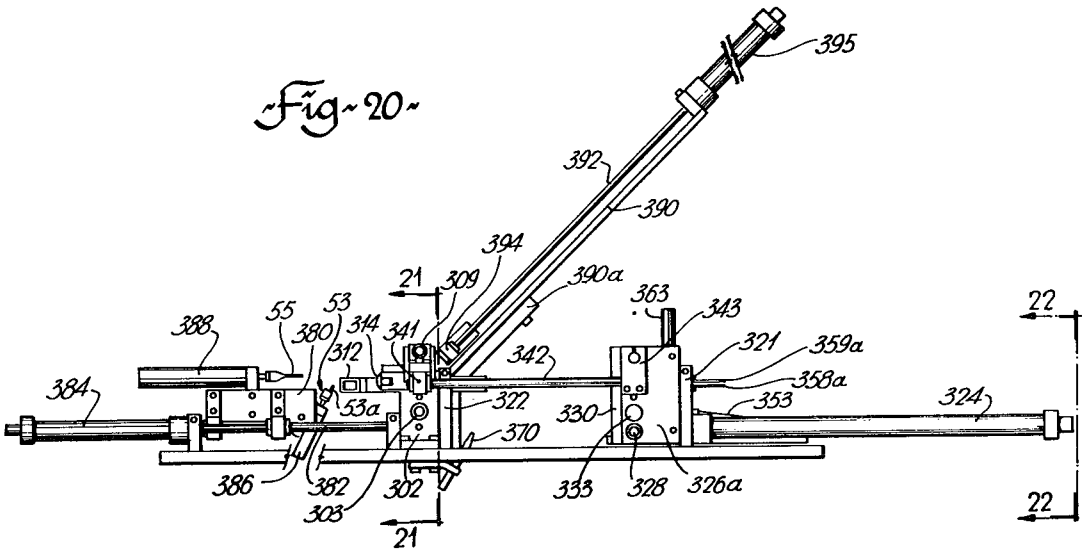
Figure 21:
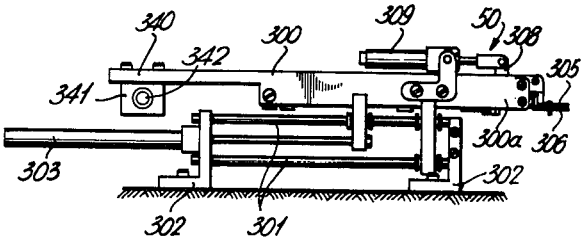
Figure 22:
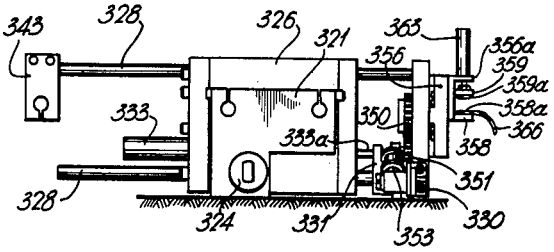
Figure 23:
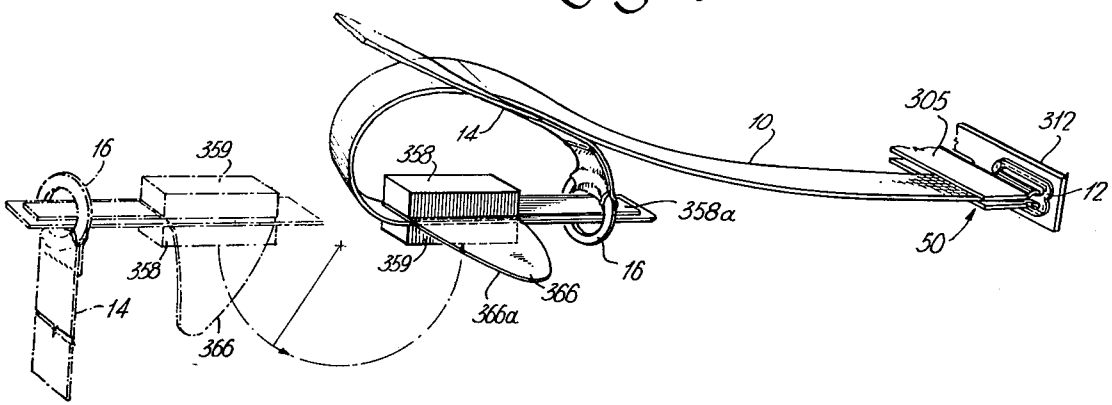
Figures 24, 24A:
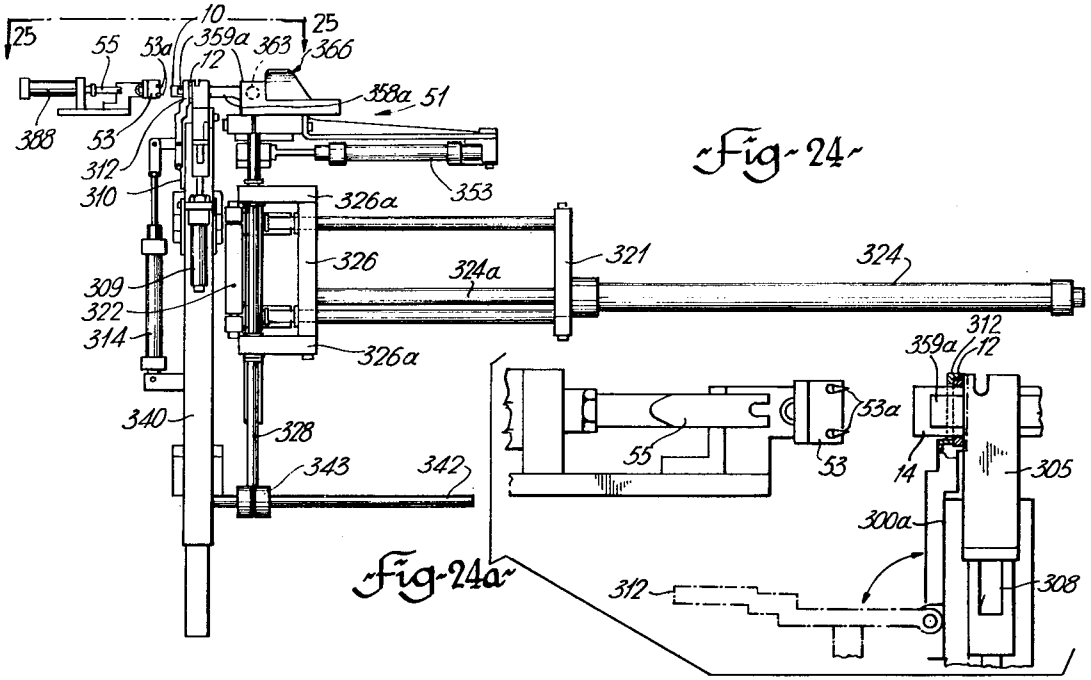
Figure 25A:
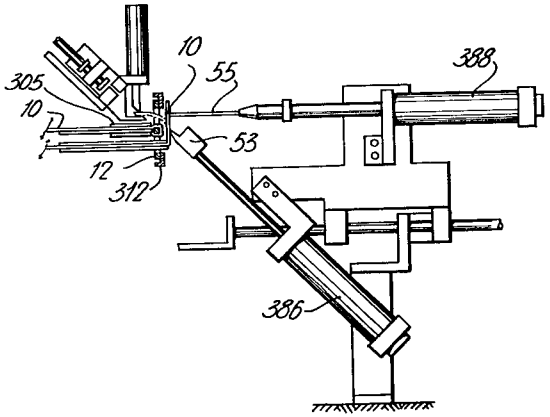
Figure 25:
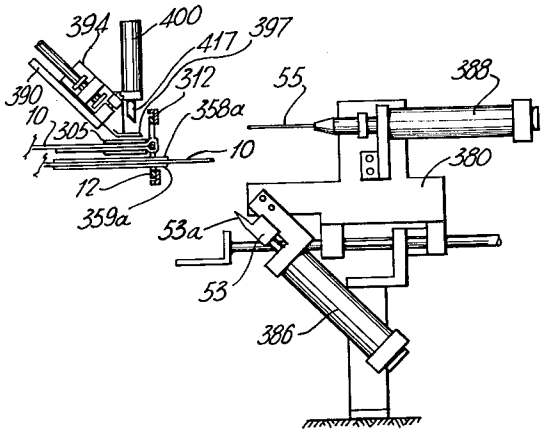

FIGS. 4A and 4B are front elevations of the machine taken along lines 4—4 FIGS. 3A and 3B respectively and showing the main components of sections A and B, FIG. 5 shows a perspective view of the left-hand part of section A of the machine (as seen from the front) showing the parts in broken lines in a first position and in full lines in a second position, FIG. 6 shows a perspective view of the righthand part of section A of the machine (as seen from the front), with parts in a first position, FIG. 7 is a plan view of section A with the parts in the second position, FIG. 8 is an elevational view on line 8—8 of FIG. 7 with parts in the second position, FIG. 9 is an enlarged elevational view of a buckle holding and transfer device of section A in its second position, and FIG. 10 is a view of the same holding and transfer device on line 10—10 of FIG. 9, FIG. 11 is a perspective view of certain components of section B of the machine in a first position, FIG. 12 shows some of the same components in a second position, FIG. 13 is a diagrammatic plan view of the main components of section B showing first, second, third and fourth positions of a ring holding and transfer device, FIG. 14 is a front elevation of section B of the machine showing the ring holding and transfer device in its first position, FIG. **14*a* is a front view of components of section B, similar to FIG. 14 but with the ring holding device removed, FIG. 14*b*, which appears on the same drawing sheet as FIG. 10, is a view on line 14*b*—14*b* of FIG. 14*a* showing the elastic tape advance device, FIG. 15 is an enlarged view of the ring holding and transfer device and the elastic threading station taken on line 15—15 of FIG. 13, FIG. 16 is a diagrammatic perspective view of parts of the ring holding and transfer device in two positions, FIG. 16*a* is a diagrammatic perspective exploded view of interior parts of the ring holding and transfer device, FIG. 17 is a perspective view of the ring holding and transfer device showing additional parts, FIG. 18 is a perspective view of components of section C of the machine as seen from the rear of the machine looking in the direction of arrow X of FIG. 2, showing the parts in full lines in an advanced position and in broken lines in a retracted position, FIG. 19 is a plan view of main components of section C with the parts in full lines in a first retracted position (and with certain parts omitted for clarity) and, in broken lines with the parts in an advanced position, FIG. 20 is a front elevational view of the whole of section C of the machine, along line 20—20 of FIG. 3A, FIG. 21 is a side elevational view on line 21—21 of FIG. 20, FIG. 22 is a side elevational view on line 22—22 of FIG. 20, FIG. 23 is a diagrammatic, perspective view of section C from the same viewpoint as FIG. 18, with the parts in a position just prior to threading of the end of the first tape portion through the buckle, FIG. 24 is a plan view of main components of section C with parts in the same position as for FIG. 23, FIG. 24***a* is an enlarged view of parts of FIG. 24, FIGS. 25 and 25*a* are rear elevational views, taken on line 25—25 of FIG. 24, of the buckling device in successive positions, FIG. 26, is a front view of a pulling clamp component, FIG. 27 is a diagrammatic view of the pulling clamp and ejector.

BRIEF SUMMARY OF MAIN COMPONENTS AND OPERATION OF MACHINE

Figure 1A:
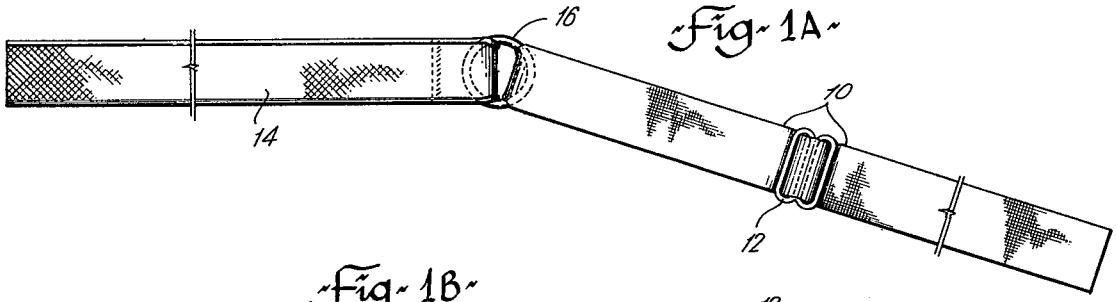
FIGS. 1A and 1B show respectively plan and side views of a completed shoulder strap as formed by the machine.
Figure 1B:
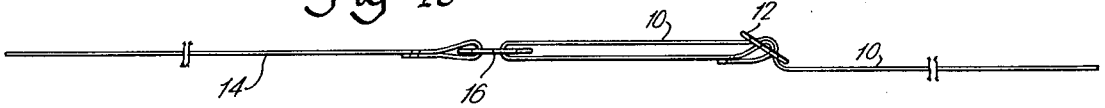

The machine is designed to produce shoulder straps for brassieres, as illustrated in FIG. 1. The strap includes a first strap portion comprising a first tape 10 which is substantially inextensible and which preferably comprises an outer envelope of smooth polyester fabric which encloses a strong fabric strip. This tape has a buckle 12 sewn onto one end, by the tape having been passed through two slots in the buckle and sewn back onto itself along a seam about ½ inch from the buckle. The second strap portion comprises a second elastic tape 14 which has had its end passed through a ring 16 and been sewn back onto itself along a seam about ½ inch from the ring. The two strap portions are united by the first tape having been passed through the ring and then through both slots of the buckle and pulled out to suitably position the buckle.

The basic components and operation of the machine will firstly be described in general terms with reference to FIGS. 2 and 3. These figures illustrate the three main sections into which the machine may be divided, namely a first section A which forms the first strap portion with the buckle, the second section B which forms the second (elastic) strap portion with the ring, and section C which unites these parts together to form the completed shoulder strap assembly.

In section A, tape 10 is supplied by a spool 20, and buckles 12 are supplied (orientated horizontally) by a magazine assembly 22. The buckles are moved from the supply position (shown in broken lines) to a vertical threading position (shown in full lines) adjacent the bed of a sewing machine 24 by means of a pivotable holding and transfer device indicated at 26. The tape material 10 is fed endwise along a horizontal path between the open blades of a knife 28 by a so-called picker 30. This picker is movable horizontally and has thin blade-like clamping members which thread the end of the tape through the upper slot in a vertically disposed buckle held in the threading position by the device 26. The projecting outer end of the tape 10 is then locked in position relative to the buckle by a locking member indicated at 31, to allow the picker to withdraw, and the free end of the tape is bent downwardly across the central area of the buckle by an air blast from the tube 32. The bent end is then tucked back through the lower slot in the buckle by a horizontally movable blade 34 into a position under the main part of the tape and situated for sewing onto this main part by sewing machine 24. The projecting end of the tape is then sewn to the main portion by the sewing machine 24.

In section B meanwhile, a ring 16 is transferred from magazine assembly 38 to a ring holding and transfer device 40 which holds the ring horizontally. The elastic tape 14 is then fed endwise from supply spool 42 by picker 44 which moves the tape between the open blades of knife 46 to a position in which an end portion of the tape overlies the ring 16. The path of movement of the tape is parallel to but spaced from the initial path of movement of tape 10 in section A. The end portion of the tape is then punched through the ring 16 by a downwardly operating punch moved by an air cylinder shown at 45 in FIG. 3B, and the picker 44 withdraws after releasing the tape. Ring 16 is then moved horizontally by the device 40 over the bed of a sewing machine 48, in such manner that the projecting end of the tape is folded back under the main portion of the tape so that the machine can then be operated to sew the two portions of tape together around the ring. After sewing, the knife 46 is operated to sever a suitable length of elastic which remains attached to the ring, and the ring 16 with the tape attached is moved into the holding position shown at 40X in FIG. 3, the ring being simultaneously rotated to the vertical position with the tape 14 hanging from its lower side.

Turning to section C, the main operative parts of this section are the clamping devices 50 and 51. Both of these are mounted for translational movement towards and away from section A, and when the sewing operation has been completed in section A these clamping devices advance together to grip the tape 10. The first device 50 clamps the tape 10 adjacent the buckle 12, and the second device 51 clamps the tape just to the left hand side of knife 28, which is then operated to sever the tape 10. The device 51 has a narrow projecting end which extends (in the advanced position of device 51) away from buckle 12, and is suitable for threading the free end of the tape 10 both through the ring 16 and through a slot in the buckle, as will be described. The devices 50 and 51 then withdraw together to bring the tape into alignment with the original direction of movement of the elastic tape 14 and of ring 16 so that the projecting end of tape 10 is suitably aligned with the ring 16, which can then be moved onto the end of the tape by further movement of device 40 along the same path which this device moved in transferring the ring from the first position to the sewing position. The device 40 then releases the ring. Then, the clamping device 51 simultaneously rotates through 180 degrees and moves towards the device 50 to bring the projecting end of the tape 10 under the main portion of this tape, and final movement of device 51 inserts the projecting end of the tape through the lower slot of buckle 12. The end of tape 10 is then pushed upwardly by part 53 of a buckling device indicated generally at 54, and is tucked back through the upper buckle slot by a pneumatically operated blade 55 which is also part of the buckling device. A pulling device 57 (shown in FIG. 3A) mounted on an inclined slideway then grasps the projecting end of the tape 10 pulling a suitable amount through the buckle to give the final strap shown in FIG. 1. The completed strap is then removed by the ejector 59.

All movements described are caused by pneumatic cylinders, operated automatically.

In the detailed description which follows, reference will be made to lateral (leftward and rightward) directions, and fore and aft (forward and rearward) directions; these will be understood as directions in horizontal planes, with lateral directions being from side to side of the machine (parallel to the main paths of tape movement), and fore and aft directions being perpendicular thereto. A forward direction will be understood as meaning towards the front of the machine which is at the bottom in the plan views.

Detailed Description of Section A of Machine

The left hand part of section A of the machine, which is particularly shown in FIGS. 5 to 7 and 8, and of which a component is shown in FIGS. 9 and 10, will now be described in detail.

The magazine assembly 22 for the buckles 12 includes a vertical tube 100 in which the buckles are vertically stacked. This tube is mounted by means of a bracket 101 attached to the machine bed and by a buckle supply assembly including two plates 103 which between them form a horizontal laterally extending passageway for horizontally disposed buckles which are pushed out of the magazine to a delivery point at the end of the passageway by a blade 104 operated by a pneumatic cylinder 105. The buckles in the tube 100 are urged downwardly by a weight to position them at the front end of blade 104.

The buckles leaving the magazine pass into the buckle holding and transfer device 26, which is shown in best detail in FIGS. 9 and 10. This device is mounted on a bracket 110 for pivotal movement about a horizontal fore and aft axis, and the device is movable by a pneumatic cylinder 112 from a generally vertical first (buckle receiving) position, indicated in FIG. 5, to a generally horizontal second threading position shown in FIGS. 5, 7, 8, 9 and 10. This device allows buckles to be positioned vertically adjacent the operative part of the sewing machine (between the sewing foot and the bed) without there being any attachments made to the sewing machine bed.

The holding and transfer device includes a main body part 114 which is directly, pivotally attached to bracket 110, and a buckle holder part 115 which, under circumstances to be described, is movable relative to part 114. Part 114 includes a box portion 117 having at its outer end a parallel sided recess in which is slideable a parallel sided lug 118 of the holder part, best shown in FIG. 9. The sides of lug 118 are parallel to the major surfaces of box part 117, so that when the device is in its second position as shown in FIG. 9 the holder part can move horizontally by the sliding of the lug 118 in its recess. Lug 118 can however be locked in position by two pins 120, shown by broken lines in FIG. 9, which are mounted at the outer end of a plate 121, this plate being pivoted centrally of the box part 117 at pivot 123, and being movable by a pneumatic cylinder 125 and its piston rod 126 to press the pins 120 into conically shaped recesses in the side of lug 118, as also shown in FIG. 9.

The buckle holder part 115 includes a plate member 129, having at one end a fixed member 130 with a groove for receiving one end of the buckle, and also slidably mounting a further grooved retainer member 132 which is urged towards member 130 by a spring 134. Members 130 and 132 are so arranged that when the device 26 is in its first, vertical position these members can receive between them a buckle which is pushed out of the magazine assembly by the blade 104. The spring 134 is sufficiently strong to hold the buckle firmly between members 130 and 132 while the device is pivoted by cylinder 112 from the first to the second position. During this movement, the position of holder part 115 is locked by extension of the cylinder 125. In its second position, the device 26 positions the buckle 12 adjacent the bed of the sewing machine 24.

The sewing machine 24 is a commercially available item known as a bar-tack machine and which is suitable for sewing of a zig-zag type of seam across a tape. For this purpose, the sewing machine includes special means for moving its bed 140 and its sewing foot 142 through a predetermined path of movement while the needle remains stationary. One small addition to the commercial sewing machine is a vertical pin 143 extending upwardly from the bed and passing through an aligned bore in foot 142. This pin is positioned just to the rear of the tape when sewn, and serves a purpose in preventing unwanted movement in a manner described below.

The left hand part of Section A also includes locking device 31 which is a blade movable by a cylinder **31*a* which is mounted at the side of the sewing machine nearest the device 26, and is inclined downwardly from this side of the sewing machine towards the position occupied by the buckle when in the second position of device 26. Cylinder 31*a* is coupled to a parallel air blast tube 32. Locking device 31 has two prongs engageable with the edges of a tape inserted by picker 30 and which straddle the clamping elements of the picker to hold the tape against the buckle and to prevent its withdrawal when the picker retracts. The air blast tube 32 causes the end of the tape, when free of the picker clamping elements, to be bent down when air is supplied to it. Also in this part of the machine is the blade 34, movable laterally by a pneumatic cylinder 34*a*, and which is aligned with the lower slot in the buckle, when positioned as shown in FIG. 5*a*** and which is suitable for tucking an end of the tape back through this lower slot after bending of the tape by the air blast, and for positioning the free end of the tape under the main part of the tape and under the needle of the sewing machine for sewing.

The right hand portion of section A will now be described with reference to FIG. 6, and also FIGS. 7 and 8.

The tape spool 20 is mounted above and to the rear of the machine on a spool holder 148 held by bracket 149, with the tape being led down through guides and then passed between a friction wheel 150 and a pressure roller 151, from which tape 10 passes horizontally under fingers 153 into picker 30 along a lateral path which is aligned with the buckle 12 in the sewing position. Friction wheel 150 is normally idle, but can be driven in such direction as to move the tape towards the right, for a purpose to be described.

The picker 30 comprises a carriage 155 movable on two vertically spaced, horizontal slide rods 157 which extend laterally, i.e., parallel to the desired path of tape movement from wheel 150 to the buckle in its sewing position. An arm 159 extends leftwards from carriage 155 and the front end of this carries a thin, flat member with a rearwardly extending part 160, and with a leftwards extending part 162. Part 162 cooperates with a similar upper member 163 carried by a part 163*a* which is pivotal relative to part 160 about pivot means indicated at 164. Part 163*a* is urged downwardly onto 162 by a piston rod of a pneumatic cylinder 166, which is mounted above part 163*a* on a fixed part 159*a* of the arm 159. Parts 162 and 163 together provide narrow projecting clamping elements capable of holding between them the free end of tape 10, and the thin, flat form of parts 160 and 162 allows these to advance the tape firstly over an anvil portion of the knife 28, and then through the upper slot of the buckle 12 held in the threading position by the device 26, elements 162 and 163 and the tape all passing through the slot. The necessary movement of the carriage 155 is provided by a pneumatic cylinder 168. The part 163*a* is spring urged upwardly, so that on release of pressure from cylinder 166 the picker can be withdrawn without withdrawing the tape. This arrangement is capable of accommodating various widths of tape.

The knife 28 operates with a scissors action, and includes a fixed anvil 170 having a horizontal surface just beneath the lowest surface of the picker element 162 (to allow this element to slide easily over the anvil), and the knife has a movable blade 172 pivotally attached to the rear of the anvil and movable by a pneumatic cylinder 174. The knife 28, spool holder bracket 149 with spool holder 148, and the friction wheel 150 and roller 151 and their associated mounting and driving means, are all mounted on a carriage 180 which is adjustable in lateral position on a bed 182. Also, knife 28 carries a rightwards extension with a stop member 184 which engages the picker carriage 155 and provides a stop for this carriage which ensures that the picker clamping elements 162, 163 are suitably spaced on the right hand side of anvil 170 when the knife operates. With this arrangement, the length of the first strap portion can readily be adjusted by shifting the position of the carriage 180 on bed 182, the picker travel corresponding to the total length of tape used in the first strap portion and being regulated by the position of stop member 184.

DETAILED DESCRIPTION OF SECTION B OF MACHINE

This section of the machine will now be described with reference to FIGS. 3B, 4B, and 11 to 17, of which FIGS. 14, 16 and 17 show detailed views of the ring holding and transfer device which is a main component of this section.

The magazine assembly 38 comprises a vertical tube 200 in which the rings 16 are vertically stacked, this tube extending upwardly from member 202 which forms a fore and aft extending slideway 203 for horizontally disposed rings, and which is itself supported on a bracket 204. Within slideway 203, a blade 206 is horizontally movable by pneumatic cylinder 207, to move the rings from the bottom of the stack in tube 200 to a delivery point which is also a threading position shown in FIGS. 2, 3, 11 and 12. As seen in FIG. 11, blade 206 has a cut away upper front portion for receiving the ring 16, this cut away portion being bounded by a V-shaped surface 206*a* which receives the side of the ring, and by a flat horizontal ring supporting surface 206*b*. As also shown in FIGS. 11, 12 and 13, the forward part of member 202 is provided with a vertical slot communicating with the centre of slideway 203, and in this slot is movable a holding element 210 which is connected by a transverse pivot 210*a* to a sliding block 211 in which element 210 is recessed. Block 211 is carried by inwardly extending forward portions 212*a* of two slide members 212 which are slideable along the outside of each side of the member 202, and which are connected at their rear ends by a cross member 212*b*. A lost-motion linkage is provided between the piston rod 207*a* of cylinder 207 and slide members 212, so that holding element 210 moves outwardly with blade 206 to retain the ring on surface 206*b*, and moves rearwardly with blade 206 but with shorter travel. The forward end of holding element 210 is urged down onto the ring 16 (when the ring is below this element) by a spring 210*b*. The holder element 210 cooperates with the blade 206 to hold a ring 16 in the recess formed by surfaces 206*a* and 206*b* while blade 206 is being extended until this ring has been successfully transferred to and clamped by the ring holding and transfer device 40, which will now be described.

The ring holding and transfer device 40, which will also be referred to as the multi-motion device, is shown in best detail in FIGS. 14 to 17.

The mounting means for the multi-motion device 40 (i.e., ring holding and transfer device) will firstly be described with reference to FIGS. 3B, 4B and 14. The device is mounted on a first carriage 220 which is slideable on horizontally spaced guide rods 221 which extend laterally and are parallel to the direction of movement of elastic tape 14. Also movable on guide rods 221 is a second carriage 224 which carries a pneumatic cylinder 226 the piston rod of which is connected to carriage 220 for causing relative movement between the two carriages. Carriage 224 is itself movable by a large pneumatic cylinder 228. A stop member 230 (FIG. 4B) is arranged to be movable into the path of travel of the first carriage 220 by a stop member cylinder 231, and this is positioned so that stop member 230 can halt the movement of carriage 220 when the device 40 is in the sewing position, i.e., is holding the ring and elastic tape suitable for sewing of the elastic by the sewing machine 48. The arrangement is such that with the two cylinders 226 and 228 fully retracted the device 40 occupies a first position which is shown in full lines in FIGS. 2, 3B, 4B, 14 and 15, in which the device is suitably positioned for receiving the ring 16 from magazine assembly 38. With the stop member 230 raised, cylinder 226 is then extended to move the carriage 220 against the stop member bringing the ring to the sewing position. After sewing, stop member 230 can be retracted and cylinder 226 fully extended to move the device 40 to the holding position 40X shown in FIG. 2. Final movement of the device to feed the ring onto the end of the first tape held by the clamping devices of section C is achieved by extending the cylinder 228 to move both carriages 220 and 224.

The first carriage 220 has a fixed bracket 234 which has bearings which pivotally support trunnions 235*a* (FIG. 15) of a tilting portion of the device shown at 235. This tilting portion is movable through a small angle, say about 10°, by a pneumatic tilting cylinder 237 having piston rod extension 237*a* (FIG. 17). This has the effect of raising and lowering the ring holding end of the device, and the raising motion is used on releasing the ring after this has been fed onto the first tape carried by the clamping devices of section C, so that the ring clamp does not interfere with the ring when being retracted.

The tilting portion 235 carries a bearing 239 for a spindle 240 (see FIGS. 16 and 17) which supports a pivotable portion of the device, indicated generally at 242, this being pivotable through about 90 degrees by a pivoting cylinder 244 (the pivoting portion also of course being tiltable by cylinder 237). Cylinder 244 allows the device to hold the ring either horizontally as required for threading and sewing, or vertically as required for feeding the ring onto the end of the first tape.

The pivoting portion 242 forms a sub-assembly (particularly shown in FIG. 16) which incorporates both a main body part 242*a* which is movable to suitably position a ring, and a ring holding part 242*b* which is movable relative to part 242*a* during the sewing operation. The main body part includes in addition to spindle 240, a plate 245 extending perpendicularly to the spindle, a body member 246 extending outwardly from the spindle, and a bracket 248 spaced normally above and parallel to the member 246. The member 246 includes a parallel sided recess in which is slideable, both longitudinally and laterally, a part 250 (FIG. 16*a*) the outer end of which provides a lower clamping member 250*a*, forming part of the ring holding part 242*b*. An upper clamping member 252 is pivotally mounted near the outer end of part 250, and includes a rearwardly extending arm 252*a* which is urged by spring means (not shown) away from part 250 to provide a clamping action at the outer end. The clamping members 250*a* and 252 include curved recesses which receive the upper and lower surfaces of about ¼ of a ring inserted between these parts. By arranging for the clamping members to engage only a portion of the ring adjacent to or between mutually perpendicular diameters of the ring, the members can receive a ring from the fore-and-aft direction, and release the ring by relative lateral motion. Thus, when the clamping members hold the ring vertically in position on the first strap portion 10 (as illustrated in the broken line portion of FIG. 16) they can be released and will clear the stationary ring upon upward movement of the clamping members caused by extension of tilting cylinder 237.

The upper portion of member 246 is centrally recessed to accommodate arm 252 and its movement while the part 250 slides laterally and longitudinally. As best shown in FIG. 16*a*, the part 250 is provided with two vertical bores, spaced on each side of arm 252*a*, and arranged to be engaged by the conical end portions of pins 253 held on the outer ends of a crosshead 254 mounted on the piston rod of a pin operating cylinder 255. When cylinder 255 is extended the pins 253 are pressed into engagement with the bores in part 250 and thus provide locking means which hold this firmly in place. When the cylinder is retracted the part 250, and with it the ring held by clamping members 250*a* and 252, is free to move with motions provided for by the sewing machine 48 which will be described. For opening the clamp at appropriate moments, a further pneumatic cylinder 257 is provided, having a piston rod 257*a* (broken line portion of FIG. 16) which can bear against the outer end of the arm 252*a* to open the clamp.

After the ring 16 has been transferred from the magazine to the multi-motion device 40, the elastic tape 14 is advanced by picker 44 over the top of the ring. The picker 44, receives the tape from spool 42 after this has passed through various guides, and between rollers 281 which advance the elastic automatically when slight tension occurs in the elastic as gauged by device 281*a*; this ensures that the elastic is supplied with little stretch.

The picker 44 comprises a carriage 260 mounted on vertically spaced laterally extending guide rods 262. The guide rods 262 are held by brackets, including upper and lower brackets 264 and 265 at the left-hand end of the guide rods, of which the bracket 264 has its top portion extending rearwardly from its main vertical portion and being such that the main part of carriage 260 can pass behind this vertical portion when in its extreme left hand position. The carriage 260 is movable by cylinder 267. Two arms 270 extend from the rear of the left-hand side of carriage 260, these including a fixed lower arm 270*a* and an upper arm 270*b* which is pivotally mounted at 271 near the front of the carriage 260 and is arranged to be pivoted downwards by the piston rod 272*a* of a vertically mounted cylinder 272 and to be pivoted upwards by a spring. The outer ends of arms 270 carry clamping blades 274 which are narrow strips of metal suitable for receiving between them the elastic tape 14, and being engageable with this tape on extension of cylinder 272. The lower clamping blade of the picker is suitably positioned so that the picker can pass over the fixed lower anvil 46*a* of knife 46 although holding the tape 14 close to this anvil.

An elastic tape clamp 280 is provided (see FIG. 3B) on the right-hand side of knife 46 and comprises upper and lower leaf springs which are each recessed for receiving the clamping blades 274 of the picker when this picker is in its retracted position and with blades 274 on the right-hand side of knife 46. The clamp 280 prevents any return motion of the tape 14 due to the weight of the hanging elastic.

Knife 46 is the same as knife 28 and will therefore not be described further. As with section A, knife 46 is mounted on a carriage 282 which also carries the clamp 280 and a stop member 284 for the picker carriage 260. Carriage 282 is adjustable along lateral slide 283 for adjustment of the length of elastic in the second strap portion. Whatever the adjustment, stop member 284 will stop rightwards movement of picker 44 so that clamping blades 274 are one-half inch or more to the right of the knife anvil; thus when the picker advances (after operation of the knife) it carries a free end of about ½ inch projecting from blades 274. The travel of the picker 44 is equal to the length of elastic in the strap portion.

The travel of picker 44 is such that in its lefthand (advanced) position it moves the free projecting end of tape 14, held between clamping blades 274, over the top of the ring 16 held by the multi-motion device 40 in its first, threading position, the blades 274 advancing just short of the centre of the ring. For threading of the elastic, two devices are provided, which are best shown in FIGS. 14*a* and 15, these being a punch in the form of a flat blade 285 vertically movable by cylinder 45, and a ring support member 287 vertically movable by cylinder 288. The member 287 is arranged so that when cylinder 288 is extended this member comes up to support the ring 16 against any possibility of being bent downwards or pushed out of the device 40, prior to punch 285 pushing the elastic tape 14 through the ring (FIG. 12) while still held by the picker.

The sewing machine 48 is again similar to that of section A, and so will not be described in detail. Again, this has a sewing foot which can descend to grip the elastic tape adjacent the ring 16, and when the ring has been moved to the sewing position by device 40, the outer end portion of the tape which has been folded underneath the remainder of the tape by movement of ring 16 onto the bed by device 40 is also gripped by the machine, so that after the pin operating cylinder 264 has unlocked the ring clamp a zig-zag seam can be sewn across the two thicknesses of elastic to hold the ring in place.

DETAILED DESCRIPTION OF SECTION C OF MACHINE

FIG. 18 shows the first and second clamping devices 50 and 51 in a first (advanced) position in which they cooperate with section A of the machine to receive the first strap portion which has been made in section A; this position is also shown in broken lines in FIG. 19.

Clamping device 50 (best shown in FIGS. 19 and 21) is mounted on a carriage 300 which is movable on guide rods 301 which are fixed to the bed of the machine by brackets 302 and which extend in the fore and aft direction. The carriage 300 is movable by cylinder 303. The end 300*a* of carriage 300 which extends towards the rear of the machine projects over the rearward end of the carriage (and is movable over both the rear bracket 302 and the bed of sewing machine 24), and pivotally mounts upper and lower clamping elements 305 and 306. These clamping elements include rearwardly extending flat strip portions, of suitable thinness to be inserted above and below a portion of tape 10 adjacent buckle 12 while the buckle is held by device 26 in the threading and sewing position, after the buckle has been sewn in place and after the sewing foot of machine 24 has been released. The clamping elements 305 and 306 each include a gear segment (not shown) within the portion 300*a* of carriage 300, these gear segments meshing with each other so that downwards movement of the end of element 306 is accompanied by upwards movement of element 305, and element 306 further includes a forwardly and upwardly extending arm, the top portion of which is seen at 308 and which is movable by the piston rod of a cylinder 309 mounted on top of the carriage 300. Thus, extension of cylinder 309 causes opening of clamping elements 305 and 306, and vice versa.

Carriage 300 carries at its side a bracket 310 which pivotally mounts an arm 311 carrying a buckle clamping door 312. The door is movable by a cylinder 314 coupled to an extension of arm 311. The door 312 is so positioned that with the buckle end of tape 10 held by the clamping elements 305 and 306, and when the tape 10 has been withdrawn from section A of the machine, the door 312 can be clamped onto the outside of the buckle. The door 312 has an aperture which is slightly smaller than the outside periphery of the buckle 12 so that when clamped onto the buckle it holds the buckle perpendicularly to the strap 10, but does not interfere with threading of tape through the slots in the buckle.

The second clamping device 51 (best seen in FIGS. 18, 19 and 22) is mounted by means allowing both translational movement towards and away from section A, parallel to the movement of device 50, and relative movement towards and away from device 50 and rotational movement. The mounting arrangement includes two laterally extending, horizontally spaced slide bars 320 which are mounted in normally fixed brackets 321 and 322, bracket 322 being quite close to the carriage 300 of clamping device 50. Movable on rods 320 by means of a laterally extending cylinder 324 having rod 324*a* is a plate 326, having two side flanges 326*a* which provide bearings for two vertically spaced slide rods 328 which extend fore and aft of the machine and which are slideable relative to flanges 326*a*. The rearmost ends of rods 328 carry a mounting plate 330, and the lower rod 328 carries a small bracket 331 spaced inwardly from plate 330, and to which is attached the end of the piston rod 333*a* of a fore and aft cylinder 333 which moves the mounting plate 330 relative to the plate member 326. Cylinder 333 has its rearward end attached to the rearmost flange 326*a*, and extends through the forward flange 326*a*. In addition, there is provided a ganging arrangement connecting the clamping devices 50 and 51, comprising a member 340 extending forwardly from the carriage 300 of clamping device 50, a bearing block 341 carried underneath the foremost end of this member, in which is slideable a rod 342 extending laterally and parallel to rods 320, and which is fixed at a right angle by block 343 to the uppermost slide rod 328. This ganging arrangement ensures that the mounting plate 330 is moved by the cylinder 333, towards and away from section A, in step with the movement of the clamping device 50 by cylinder 303.

The mounting plate 330 supports a fore and aft spindle 349 which carries at its forward end a gear 350, and outside the plate 330 this spindle carries the rotatable second clamping device 51. The gear 350 meshes with a lower gear segment 351 which is mounted on the lower slide rod 328 and which is rotatable through about 90° by means of a cylinder 353 the outer end of which is attached to plate 330 by bracket 354. The gear 350 has about half the radius of segment 351, so the cylinder 353 produces a rotation of about 180 degrees in the second clamping device. The second clamping device includes a main body portion 356, having near to one side a lower rearwardly extending lug 356*a* which carries a fixed lower clamping part 358. An upper, rearwardly extending lug 356*a* carries a cylinder 363, the piston rod of which carries an upper clamping part 359. Each of these parts 358 and 359 is provided with a strip like clamping element 358*a*, 359*a* which extends laterally of the machine and which is disposed to the rear of the body portion 356. These clamping elements are narrow strips of metal capable of holding between them the tape 10 and dimensioned so as to be capable of threading a free end of this tape through a slot in the buckle 12, as well as into the ring 16.

When clamping devices 50 and 51 are advanced to receive tape 10 from section A as described, clamping elements 358*a* and 359*a* are positioned close to the anvil 28 of knife 30. To accommodate changes of the length of tape 10 by adjustment of carriage 180 as described, bracket 321 is movably mounted to allow adjustment of the right hand position of the clamping device 51.

A further feature of clamping device 51 is a tongue 366 which extends just underneath the clamp element 358*a* when this is disposed in the position shown in FIG. 20, and this helps to guide the tape 10 between the elements 358*a* and 359*a* when the clamping device is advanced into the tape holding position as shown in FIG. 18. Tongue 366 has a sloping side face 366*a* which serves the function of pushing the tape 10 out of the clamping device 51 after the tape has been threaded into buckle 12 and is held relative to the buckle and while the clamping member 51 retracts from the buckle.

Another feature of the transfer device assembly, in relation to its function of bending the tape 10 after ring 16 has been threaded onto its end and reinserting this through a slot in the buckle, is an air blast tube 370 (FIG. 20), attached to the side of bracket 322, and angled upwardly and rearwardly and arranged so as to cause the elastic strip attached to the ring to be blown upwardly and rearwardly from the portion of the strap being inserted through the buckle.

The buckling device which buckles the free end of tape 10 through the upper slot in the buckle after the clamping device 51 has inserted this through the lower slot, is shown on the left-hand side of device 50 in FIG. 20, and from the opposite (rear) view in FIGS. 25 and 25*a*. The buckling device comprises a carriage 380 mounted on laterally extending guide rods 382 and movable towards and away from the clamping device 50 by a cylinder 384. The carriage 380 mounts a cylinder 386 the piston rod of which carries the device 53 which is movable upwardly and slightly towards the clamping device 50 by the cylinder 386. The device 53 has a bifurcated upper end, providing two prongs 53*a* which, as shown in FIG. 24*a*, are spaced apart to accommodate the narrow clamping elements 358*a*, 359*a* of clamping device 51 but which are close enough together to engage the edge portions of the tape 10, as shown in FIG. 25. Thus, when device 53 has been raised it both bends upwardly the outer end portion of tape 10 and also holds this against the gate 312, and allows the clamping device 51 to be withdrawn without pulling back the tape 10. On the side of carriage 380 is mounted a cylinder 388 which moves horizontally the blade 55 which is movable between prongs of part 53 to insert the strap 10 through the upper slot of a buckle held by the door 312 as indicated in FIG. 25*a*.

The pulling clamp 57, best shown in FIGS. 20, 25 and 26, is mounted on a plate 390 held by an angled bracket 390*a* so as to extend laterally of the machine, and upwards and rightwards at about 45°. The plate 390 carries brackets which support two slide rods 392, on which a carriage 394 is movable by a pulling cylinder 395. The carriage 394 mounts, at its lower end, a small horizontal plate 397 having a sharpened forward end, and the arrangement is such that with the carriage 394 in its lowermost position this forward end of plate 397 is adjacent the lower side of the upper slot in a buckle 12 held by the gate 312 of the first clamping device 50. Carriage 394 also mounts a bracket 399 carrying cylinder 400 which has a piston rod 401 with a sharpened end, this forming the movable part of the pulling clamp. Thus, when the end of the tape 10 has been buckled by the buckling device and has been inserted through the upper slot in buckle 12 by blade 55 and over the suitably positioned plate 397, this end can be grasped between plate 397 and piston rod 401 by extension of clamping cylinder 400, upon which cylinder 395 is retracted to pull an outer end portion of the tape 10 through the buckle.

The ejector 59 shown in FIGS. 3A, 4A and 27 is mounted on a bracket 410 which extends upwardly from the bed of the machine between sewing machine 24 and knife 28, and which provides bearing means for a slide rod 411 which has its forward end fixed to the ejector 59. Also fixed to ejector 59 is the front end of the piston rod 413*a* of a cylinder 413, the cylinder extending rearwardly from the bracket 410 parallel to and below slide rod 411 so that the piston rod and rod 411 together slidably support ejector 59. The orientation of the bracket 410 and the bearing for rod 411 is such that when cylinder 413 is extended the ejector 59 moves with the rod 411 in a downwards slanting manner in a path directed generally towards the clamping device 50. The ejector includes a lower fixed jaw 415, and an upper clamp member 417 formed by the lower end of the piston rod of cylinder 418. The arrangement is such that after the pulling device 57 has pulled a suitable length of tape 10 through the buckle, and after clamping device 50 and the door 312 have released the buckle end of the first strap portion, a part of the tape 10 between the pulling clamp 57 is grasped between the lower jaw 415 and piston rod 417 of the ejector, and after the pulling clamp has released its grip on tape 10 the ejector can be moved rearwardly by retraction of cylinder 413 to a position behind the machine, where the completed strap can then be released into a chute which takes the completed strap to a bin.

OPERATION

Operation of the machine will now be described.

All the cylinders referred to above are pneumatic cylinders supplied with air through valves controlled by an automatic programmer, of the type sold under the trade name Agastat by Amerace-Esma Corporation, of the U.S.A.

Operations proceed simultaneously in Sections A, B and C so that while a first strap portion is being formed in Section A, and a second strap portion is being formed in Section B, Section C is performing various buckling and associated operations which unite together two strap portions previously formed in Sections A and B.

In Section A, a cycle starts with the buckle holder and transfer device 26 in the vertical position, with cylinder 125 extended to cause pins 120 to lock the buckle holder part 115 in position, with knife 28 open, and with picker 30 retracted to its right hand position, and with the picker clamping elements 162 and 163 held closed by the cylinder 166.

Cylinder 105 is then extended so that blade 104 pushes a buckle from the magazine 100 into the buckle holder 115, and then cylinder 112 is retracted to rotate the device 26 into the threaded position (FIGS. 8 and 9) in which the buckle is held vertically near the sewing foot and bed of the sewing machine 24. Simultaneously, cylinder 168 is retracted to advance the picker 30, the clamping elements 162 and 163 of the picker pulling tape 10 from the supply spool between friction wheel 150 and roller 151, which are idle at this stage, and final movement of the picker threads the tape through the upper slot in the buckle until about one-half inch of the tape extends through this slot (see FIG. 8). Friction wheel 150 is then briefly driven in the reverse direction to tighten the tape 10. Cylinder 31*a* is then extended to bring locking fork 31 into contact with the tape 10 and to hold a part of the tape against the central portion of the buckle, so that when the picker clamping elements have been released from the tape the picker can return to its initial position without pulling the tape from the buckle. Simultaneously, a blast of air from the tube 32 turns down the end of tape which projects through the buckle, and then cylinder 34*a* moves the blade 34 through the lower slot in the buckle, and then immediately retracts this blade, to tuck the free end of the tape through the lower slot and into a position adjacent to and underneath the main portion of the tape and in suitable position for being sewn thereto by the sewing machine 24. With locking fork 31 retracted, the sewing machine foot moves down to clamp the two layers of tape against the sewing machine bed. The cylinder 125 of the buckle holder and transfer device is then retracted to release the holding part 115 and to allow this to slide around while the tape clamped by the sewing foot is moved by the sewing machine as this sews a zig-zag seam. After sewing cylinder 125 is again extended to lock part 115, the sewing foot is raised, and the picker clamping elements are closed. At this stage, the first strap portion is virtually complete, except that it is still connected to the supply of tape.

The next series of operations transfers the first tape portion to Section C of the machine. The clamping devices 50 and 51 of Section C are advanced towards Section A by cylinders 303 and 333, while the clamping elements 305 and 306 of the device 50 are held open by cylinder 309, and clamping elements 358*a* and 359*a* of device 51 are held open by retraction of cylinder 363. Also, during this movement, the gate 312 is held open by cylinder 314, and device 51 is in its right hand position as shown in FIG. 2 (i.e. cylinder 324 is retracted) and the clamping elements 358*a* and 359*a* are directed towards the right hand side of the machine by a suitable operation of the rotating cylinder 353.

With clamping devices 50 and 51 fully advanced on to tape 10 as illustrated in FIG. 18, the device 50 is positioned about one quarter inch to the right hand side of buckle 12, and device 51 engages the tape 10 at a position quite close to the cutting line of knife 28. The tongue 366 helps to guide the tape 10 into the clamping device 51. The clamping element of device 50 is then closed for a short period to hold the buckle while the buckle holder and transfer device 26 is returned to its initial vertical position, releasing the buckle. Then, with the clamping elements of both devices 50 and 51 open, the motor 150 is driven in such direction as to move the strap towards the right, and this properly positions the buckle at the side of clamping devices 305 and 306. The pin 143 on the sewing machine prevents undesired rearward movement of the tape at this stage. The clamping elements of devices 50 and 51, and also of picker 30, are again closed, and knife 28 is operated to sever the tape 10. Then, the devices 50 and 51 are retracted into the position shown in FIGS. 2 and 3, after which the door 312 is closed by cylinder 314 to hold the buckle firmly in the vertical pane. The first strap portion is then suitably positioned for receiving the ring of the second strap portion formed in Section B.

In Section B, the cycle begins with the picker 44 withdrawn to its rightward position, and picker clamp blades 274 closed by cylinder 272, and blades of knife 46 open. The multimotion device 40 is in its right hand position shown in full lines in FIGS. 2*b* and 3 and has its rotatable portion suitably orientated by cylinder 244 so that the clamping members 250*a* and 252 can receive the ring 16 horizontally from magazine assembly 38. The tilting cylinder 237 is retracted. Also, cylinder 255 is extended to lock the clamping members relative to the main body part of device 40, and the clamping members 250*a* and 252 are held open by extension of cylinder 257.

The magazine blade 206 is advanced by cylinder 207 and moves ring 16 between the clamping members 250*a* and 252, undesired tilting of the ring being prevented by the holding element 210 which advances with the blade 206 during the latter part of its movement. The clamping members are then closed by spring action on retraction of cylinder 257 (see FIG. 11), and blade 206 and element 210 withdraw leaving the ring held horizontally in the device 40.

Previous operations have left an end portion about one half inch in length of the tape 14 extending in advance of the clamping blades 274 of picker 44. The picker is advanced under the action of cylinder 267 and moves this end portion of the tape over the top of ring 16, the picker advancing to a position in which its blades 274 are just short of the center line of the ring. The ring support member 287 is then raised by cylinder 288 into position to prevent downward movement of the ring 16, and shortly afterwards punch 285 is moved downwardly by cylinder 45 to move the end portion of tape 14, previously lying across the top of the ring, into position in each it hangs through the ring (see FIG. 12). While the punch remains down, picker blades 274 open and the picker retracts to its initial position leaving the elastic threaded. The friction between the sides of the elastic tape and the ring is sufficient to prevent rightward movement of the tape. Also, spring clamp 280 at this point prevents the weight of the elastic tape leading from the supply spool from causing reverse movement of the tape. The ring support member 287 and punch 285 then retract away from the ring. Picker blades 274 again close, and knife 46 then operates to sever a suitable length of tape about one half inch in front of blades 274, thus servering the length of tape required for the second strap portion.

With stop member 230 raised, cylinder 226 is extended to move the multimotion device 40 against the stop member 230 and into a position in which it holds the ring 16 in its sewing position just at the left hand side of the operative portion of sewing machine 48. This movement folds the previously hanging end portion of tape 14 back underneath the main portion of the tape so that the two thicknesses of tape can be held together by the sewing foot which now descends onto the bed of the sewing machine. Cylinder 255 of the multi-motion device then retracts to unlock the holding part including clamping members 250*a* and 252, to allow the two tape thicknesses adjacent the ring to be sewn together with a zig zag seam while the part 250 slides around in body member 246. After sewing, the cylinder 255 again locks the clamping members in position while the sewing foot is raised. Stop member 230 is then retracted and cylinder 226 fully extended to move the multi-motion device 40 to its holding position 40X (FIG. 2), and simultaneously cylinder 244 rotates the rotatable part of this device to orientate the ring in vertical position with the attached tape hanging from the lower side of the ring.

At this stage, movements in Sections A and C have progressed as described above so that the first tape is suitably held by devices 50 and 51 so that further movement of the multimotion device 40 in the leftward direction, under the influence of cylinder 228, moves the ring onto the free end of the first tape held by the clamping elements 358*a* and 359*a*. Opening cylinder 257 of device 40 then extends to open the clamping elements 250*a* and 252, and the tilting cylinder 237 is extended to tilt the whole tilting end portion of the device 40 about 15° so that the clamping elements can clear the ring as the device 40 is retracted and rotated in returning to its initial position.

The further operations performed in Section C of the machine can best be understood with reference to FIGS. 20, and 23 to 27.

Firstly, the free outer end of the first strap portion 10, now carrying the ring 16 and the remainder of the second strap portion, is inserted through the lower slot of buckle 12 by simultaneously extending cylinder 324 to move the clamping device 51 towards clamping device 50, and at the same time extending cylinder 353 to rotate the clamping device 51 in a clockwise direction as seen from the front of the machine. As indicated in FIG. 23, the outer end of the tape 10 is thus brought under the remaining part of this tape, and final movement of clamping device 51, when it is aligned with the lower slot of buckle 12, inserts the free end through the buckle slot. During this movement, air from blast tube 370 blows the second strap portion rearwardly of the machine and out of the way of the buckle.

At the same time, cylinder 384 has advanced the carriage 380 carrying the buckling devices, and when this is in position (as shown in FIGS. 25 and 25*a*) cylinder 386 raises the locking device 53 so that its prongs 53*a* contact the edges of the tape 10 and hold this against the central area of the buckle. The clamping elements of device 51 are then opened by retraction of cylinder 363, and device 51 is returned to its initial position relative to device 50, the tape 10 previously held by device 51 being moved out of its clamping elements by the sloping surface 366*a* which faces to the right hand side of the machine at this stage and pushes the strap 10 rearwardly out of the clamping elements of device 51. Tape 10 is meanwhile held by locking device 53. This device bends the end of the tape upwards so that on advance of the blade 55 by cylinder 388 the end of the tape is tucked through the upper slot of the buckle.

Prior to this operation, cylinder 395 of the pulling clamp 57 has been extended to position the small plate 397 with its forward edge adjacent the center of the buckle, so that the free end of the strap 10 is moved by blade 55 over the top of this plate and underneath the pulling clamp portion formed by the piston rod 401. Cylinder 400 is then extended to clamp this outer end of the tape 10, and cylinder 395 is retracted to pull the tape 10 through the buckle and suitably position the buckle on this tape.

Prior to the pulling operation, the ejector 59 has been suitably positioned by extension of its cylinder 413, to position its lower fixed jaw adjacent to the pulling clamp so that the tape 10 is received on this jaw. When pulling has been completed, the ejector clamp member 417 is closed by extension of cylinder 418, and simultaneously the buckle clamp door 312 is opened. Retraction of the cylinder 418 then moves the ejector to the rear of the machine, carrying the completed strap, which is dropped into a chute behind and to the side of the sewing machine 24.

We claim:

1. Apparatus for forming a strap of the type having first and second strap portions united together, the first strap portion being a first tape with a free end and a buckle end with a two-slot buckle attached thereto, the second strap portion being a second tape with a ring attached to one end thereof, including means for uniting the first and second strap portions which means comprise:

a first clamping device for holding the buckle end of the first strap portion with the buckle disposed substantially perpendicular to the end part of the first strap portion adjacent said buckle, a second clamping device having a narrow projecting end for holding the free end of the first strap portion and being suitably dimensioned for inserting this free end through the ring of the second strap portion and also into a first slot of the buckle, means for causing relative movement of said clamping devices between an initial position in which the free end of the first strap portion is suitably orientated for receiving the ring, and a final position in which the said free end is inserted into said first slot in said buckle.

2. Apparatus according to claim 1, further comprising:

means for bending the free end of the first strap portion which projects through said first buckle slot towards the second buckle slot, and means for subsequently inserting said free end through said second slot in said buckle.

3. Apparatus according to claim 2 wherein means are provided for pulling the free end of the tape through the buckle after this end has been passed through the second slot so as to suitably position the buckle on the tape of the first strap portion.

4. Apparatus according to claim 1 wherein said first clamping device has a movable door which clamps on to the buckle to hold this in vertical position during the threading operations, said door being apertured in the area of the buckle slots.

5. Apparatus according to claim 1, wherein said means for causing relative movement between said clamping devices includes means for rotating said second clamping device between said initial position in which the free end of the first strap portion is suitably orientated for receiving the ring and a second position in which the said free end is aligned with said first slot in said buckle, and further includes means causing relative movement between the first and second clamping devices from relatively separated to cooperating positions to insert the free end of the first strap portion into said first buckle slot when said second clamping device is suitably aligned therewith and after the ring has been placed on the free end of the first strap portion.

6. Apparatus according to claim 5 wherein the means for rotating the second clamping device turns this through 180° from an orientation in which the first tape is held substantially straight with its free end pointing away from the buckle, to an orientation in which the free end is pointing towards the first slot in the buckle.

7. Apparatus according to claim 1, further comprising a first machine section for uniting the buckle with the first tape to form the first strap portion and for holding the first tape straight after the buckle has been secured thereto, and wherein the clamping devices are arranged for translational movement from an advanced position in which the clamping devices clamp on to the first tape while this is held in said first section, to a retracted position in which the free end of the first strap portion is suitably exposed to receive the ring.

8. Apparatus according to claim 1, further comprising a ring holding and transfer device for holding the ring with the second tape attached thereto and movable relative to the second clamping device to place the ring on the free end of the first strap portion held thereby.

9. Apparatus according to claim 8, wherein said ring holding and transfer device is mounted for movement from a first position in which the ring is positioned for threading of the second tape therethrough to a second position in which the second tape is secured onto the ring, and wherein said two positions of the ring during threading and securing of the tape are aligned with the free end of the first strap portion when held by said second clamping device in said initial position, whereby the ring can be moved onto the projecting end of the first strap portion by further movement of the holding and transfer device along the same path as this moves to transfer the ring from the threading to the securing position.

10. Apparatus according to claim 9, wherein said two clamping devices are such as to hold said first strap portion horizontally and wherein the ring holding and transfer device is such as to hold the ring horizontally during threading of the second tape and securing of the second tape to the ring, and wherein the ring holding and transfer device includes a rotatable portion capable of rotating the ring through 90° after the second tape has been secured to the ring and before feeding of the ring on to the free end of the first strap portion.

11. Apparatus for forming a strap of the type having first and second portions united together, the first strap portion being a first tape with a free end and the second strap portion being a second tape with a ring attached thereto and threaded onto the first tape, including means for securing the ring onto the second tape and for uniting the second strap portion so produced with the first strap portion, said uniting means including clamping means for said first strap portion suitable for holding said first strap portion horizontally and including elongated clamping elements for holding the free end of the first strap portion, said clamping elements being capable of passing through said ring, said means for securing the ring to the second tape including a ring holding and transfer device having clamping means suitable for receiving a horizontally presented ring and for holding the ring horizontally during threading of the second tape therethrough, and also including means for moving said holding and transfer device in a horizontal direction to move the ring held by the clamping means to a securing position in which parts of the threaded tape adjacent the ring are joined together to secure the ring to the second tape, said moving means providing for further movement of the ring in said horizontal direction towards the free end of the first strap portion held by said clamping elements, said holding and transfer device also including a rotatable portion carrying the clamping means whereby the ring can be rotated into the vertical plane and can be fed on to the horizontally extending free outer end of the first strap portion on final movement of said holding and transfer device.

12. Apparatus according to claim 11, wherein the clamping means of the holding and transfer device is shaped to engage only a portion of the ring adjacent to or between mutually perpendicular diameters of the ring, whereby the clamping means can accept the ring by relative movement between the ring and the clamping means in a first direction in the plane of the ring and can release the ring by relative movement in a direction perpendicular to the first direction and also in the plane of the ring.

13. Apparatus according to claim 12, wherein the clamping means is mounted upon a part of the ring holding and transfer device which is tiltable about a horizontal axis and including means for causing said tilting movement, so that when the clamping means have been rotated to hold the ring in the vertical plane and when the ring has been fed on to the free end of the first strap portion held by said elongated clamping elements, the clamping means can be released from the ring and lifted clear of the ring by tilting of said tiltable part to allow the holding and transfer device to return to the threading position without interferring with the ring.

14. Apparatus for uniting first and second strap portions of a strap of the type having first and second strap portions united together, the first strap portion being a first tape with a free end and a buckle end with a two-slot buckle attached thereto, the second strap portion being a second tape with a ring attached to one end thereof, including:

a first clamping device for holding the buckle end of the first strap portion with the buckle disposed substantially perpendicular to the end part of the first strap portion adjacent said buckle, a second clamping device having a narrow projecting end for holding the free end of the first strap portion and being dimensioned for inserting this free end into a first slot of the buckle and also through the ring, means for causing relative movement of said clamping devices between an initial position in which the free end of the first strap portion is suitably orientated for receiving the ring, and a final position in which the said free end is inserted into said first slot in said buckle, means for locking said free end in position relative to the buckle to allow withdrawal of said second clamping device, means for bending said free end towards a second slot of the buckle, and means for pushing said free end through said second slot in the buckle.

15. Apparatus according to claim 14, further comprising pulling means including a pulling clamp and means for moving said clamp between a first position adjacent the second slot of the buckle when the buckle is held by the first clamping device, said pulling clamp including clamping elements suitable for receiving between them the free end of the first strap portion when this has been pushed through the second slot in the buckle, said pulling clamp being capable of clamping said free end and pulling the tape through the buckle to suitably position the buckle relative to the tape before ejection of the completed strap from the apparatus.

16. A method for uniting the first and second strap portions of a strap of the type having first and second strap portions united together, the first strap portion being a first tape with a free end and a buckle end with a two-slot buckle attached thereto, the second strap portion being a second tape with a ring attached to one end thereof, including the steps of:

holding the first strap portion substantially flat with the buckle disposed substantially perpendicular to the strap portion, and in such manner that said first strap portion has the free end thereof projecting, feeding the ring attached to the second strap portion onto the projecting free end of the first strap portion, rotating the free end of the first strap portion through substantially 180° while causing relative movement between this free end and the buckle to bring this free end adjacent to and into alignment with a first slot in the buckle and then inserting the free end into the slot, bending the free end of the first strap portion projecting through the first slot in the buckle and then feeding this free end through a second slot in the buckle.

17. A method according to claim 16, including the steps of:

forming a first strap portion by feeding a first tape endwise along a first horizontal path and inserting the free end of the tape through one slot of a vertically disposed buckle, tucking the projecting end of the tape back through the other slot of the buckle and securing said projecting end onto the main portion of the tape, holding said first strap portion by a first clamping means applied to the strap portion adjacent the buckle and by a second clamping means spaced from said buckle at a distance less than the desired length of the first strap portion, and severing the first tape adjacent the end of the second clamping device to provide a projecting end suitable for receiving said ring.

18. A method according to claim 16, including the step of:

forming the second strap portion by feeding the second tape endwise along a horizontal path into parallel overlapping relationship with a horizontally disposed ring, and punching said second tape through said ring, cutting off a predetermined length of said second tape, moving said ring and tape along an extension of said horizontal path to a securing position and securing the end of said second tape to the main portion of the second tape, and rotating said ring into a vertical orientation and moving said ring to feed it onto the projecting end of said first strap portion.

19. A method for forming a strap of the type having first and second strap portions united together, the first strap portion being a first tape with a free end and a buckle end with a two-slot buckle attached thereto, the second strap portion being a second tape with a ring attached to one end thereof, comprising the steps of:

forming the first strap portion by feeding the first tape endwise along a first horizontal path and inserting an end of the tape through one slot of the vertically disposed buckle, tucking the projecting end of the tape back through the other slot of the buckle and securing said projecting end onto the main portion of the tape, forming the second strap portion by feeding the second tape endwise along a second horizontal path disposed parallel to and spaced from said first horizontal path, into parallel overlapping relationship with the horizontally disposed ring, and punching said second tape through said ring, cutting off a predetermined length of said second tape, moving said ring and tape along an extension of said second horizontal path to a securing position and securing the end of said second tape to the main portion of the second tape, holding said first strap portion by a first clamping means applied to the strap portion adjacent the buckle and by a second clamping means spaced from said buckle at a distance less than the desired length of the first strap portion, severing the first tape adjacent the end of the second clamping device to provide a projecting end suitable for receiving said ring, retracting said clamping devices to bring said first strap portion into alignment with said second horizontal path, rotating said ring into vertical orientation and moving said ring to feed it onto the projecting end of said first strap portion, rotating said second clamping device through 180° and causing relative movement between said first and second clamping devices to feed the projecting end of the first tape through a first slot in the buckle, and bending the end of the first tape projecting through the buckle and pushing the end through a second slot in the buckle.

* * * * *